US010821743B2

(12) United States Patent
Tanaka

(10) Patent No.: US 10,821,743 B2
(45) Date of Patent: Nov. 3, 2020

(54) RECORDING DEVICE AND RECORDING METHOD

(71) Applicant: SEIKO EPSON CORPORATION, Tokyo (JP)

(72) Inventor: Kentaro Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 16/403,713

(22) Filed: May 6, 2019

(65) Prior Publication Data

US 2019/0344582 A1 Nov. 14, 2019

(30) Foreign Application Priority Data

May 8, 2018 (JP) ..... 2018-089695

(51) Int. Cl.
*B41J 2/355* (2006.01)
*B41J 2/21* (2006.01)

(52) U.S. Cl.
CPC ..... *B41J 2/3558* (2013.01); *B41J 2/211* (2013.01); *B41J 2/2125* (2013.01)

(58) Field of Classification Search
CPC ..... B41J 2/211; B41J 2/2125; B41J 2/14016; B41J 2/04551; B41J 2/0457; B41J 2/0458; B41J 2/3558; B41J 2002/14491; B41J 2002/2128; B41J 2002/2132; B41J 2002/2139; B41J 2002/2142
See application file for complete search history.

(56) References Cited

U.S. PATENT DOCUMENTS 4,769,653 A 9/1988 Shimoda
2011/0134175 A1* 6/2011 Hong et al. ..... B41J 2/04506
2013/0286068 A1* 10/2013 Itaya et al. ..... B41J 2/04506

FOREIGN PATENT DOCUMENTS

JP 06-079853 B2 10/1994
JP 2004-284064 A 10/2004

* cited by examiner

*Primary Examiner* — Juanita D Jackson
(74) *Attorney, Agent, or Firm* — Global IP Counselors, LLP

(57) ABSTRACT

A recording device includes a head including a plurality of nozzles discharging ink droplets and a head including a plurality of nozzles discharging ink droplets of a color identical to that of the ink droplets, a driving circuit configured to drive the former head at a drive voltage and drive the latter head by another drive voltage, an input unit configured to receive an input of selection information selected, based on comparison between a print image printed by the former head and a plurality of other print images G2 printed by the latter head, with the other drive voltage being changed individually, and a control unit configured to control the drive voltage and the other drive voltage, based on the selection information input from the input unit.

6 Claims, 21 Drawing Sheets

RECORDING DEVICE AND RECORDING METHOD

The present application is based on, and claims priority from JP Application Serial Number 2018-089695, filed May, 8, 2018, the disclosure of which is hereby incorporated by reference herein in its entirety.

BACKGROUND

1. Technical Field

The disclosure relates to a recording device including a plurality of heads (nozzle rows) constituting a discharge unit for discharging droplets and a recording method executed by the recording device.

2. Related Art

An ink jet-type printer is known that includes a plurality of heads constituting nozzle rows discharging ink droplets.

For example, JP-B-6-79853 describes a liquid ejecting device causing an amount of ink corresponding to a concentration signal to be discharged through each of discharge ports (nozzles) in a plurality of heads to perform gray-scale recording on a recording target body (recording medium), the liquid ejecting device including electromechanical converting elements provided for the respective discharge ports to generate energy causing the ink to be discharged through the discharge ports, and a driving unit provided for the respective discharge ports to supply the electromechanical converting elements at the respective discharge ports with a drive signal with a plurality of levels set according to discharge characteristics, in order to allow the same amount of ink to be discharged from the discharge ports in the heads with different discharge characteristics at each stage of the concentration signal, wherein the levels of the drive signal corresponding to the stages of the concentration signal and an amount of change between the levels of the drive signal are set based on the discharge characteristics.

The liquid ejecting device is described as preventing a concentration range on recording paper from varying among the discharge ports of the plurality of heads.

Furthermore, JP-A-2004-284064 describes an image output device including an applied voltage value determining unit for determining a voltage value of a voltage to be applied to an ink discharging unit, based on a value of a voltage to be applied determined by an applied voltage value determining method including a measurement voltage applying step of applying a measurement voltage with a plurality of values to an ink discharge unit (head), a printing step of printing a medium by using ink discharged from the ink discharging unit by application of the measurement voltage, a concentration measuring step of measuring a concentration of the ink applied to the medium, and an applied voltage value determining step of determining the value of the voltage to be applied to the ink discharge unit in a case where a prescribed concentration is to be achieved on the medium, based on the value of the measurement voltage and the corresponding measured value of the concentration.

The image output device is described as being capable of determining the value of the voltage to be applied to the ink discharging unit and eliminating individual differences among ink discharging units.

However, the liquid ejecting device described in JP-B-6-79853 disadvantageously needs to preliminarily measure and determine, as a discharge characteristic for all the heads, a relationship between a drive voltage and a dot diameter of dots formed by the drive voltage.

Furthermore, the image output device described in JP-A-2004-284064 disadvantageously needs to preliminarily measure and determine, as a discharge characteristic for all the heads, a relationship between the value of the measurement voltage and the concentration of the ink applied by the measurement voltage.

SUMMARY

A recording device according to an aspect of the disclosure includes a first nozzle row including a plurality of nozzles discharging droplets and a second nozzle row including a plurality of nozzles discharging droplets of a color identical to that of the droplets discharged from the first nozzle row, a driving circuit configured to drive the first nozzle row at a first voltage and drive the second nozzle row at a second voltage, an input unit configured to receive an input of selection information selected, based on comparison between a first recording image recorded by the first nozzle row and a plurality of second recording images recorded by the second nozzle row, with the second voltage being changed individually, and a control unit configured to control the first voltage and the second voltage, based on the selection information input from the input unit.

The above-described recording device preferably includes a storage unit configured to store the selection information input from the input unit.

In the above-described recording device, the plurality of second recording images to be compared with the first recording image are preferably recorded by the second nozzle row driven at the second voltage set with a plurality of differential voltages that are integral multiples of a prescribed differential voltage with respect to the first voltage.

In the above-described recording device, the first recording image is preferably recorded between the plurality of second recording images.

In the recording device, the input unit is preferably configured to accept a change instruction for changing the prescribed differential voltage.

A recording method according to an aspect of the disclosure is a recording method for a recording device including a first nozzle row including a plurality of nozzles discharging droplets and a second nozzle row including a plurality of nozzles discharging droplets of a color identical to that of the droplets discharged from the first nozzle row, and a driving circuit configured to drive the first nozzle row at a first voltage and drive the second nozzle row at a second voltage, the recording method including recording a first recording image by the first nozzle row and recording a plurality of second recording images by the second nozzle row, with the second voltage being changed accordingly, accepting an input of selection information selected based on comparison between the first recording image and the plurality of second recording images, and controlling the first voltage and the second voltage, based on the selection information that has been input.

DESCRIPTION OF EXEMPLARY EMBODIMENTS

Figure 1:
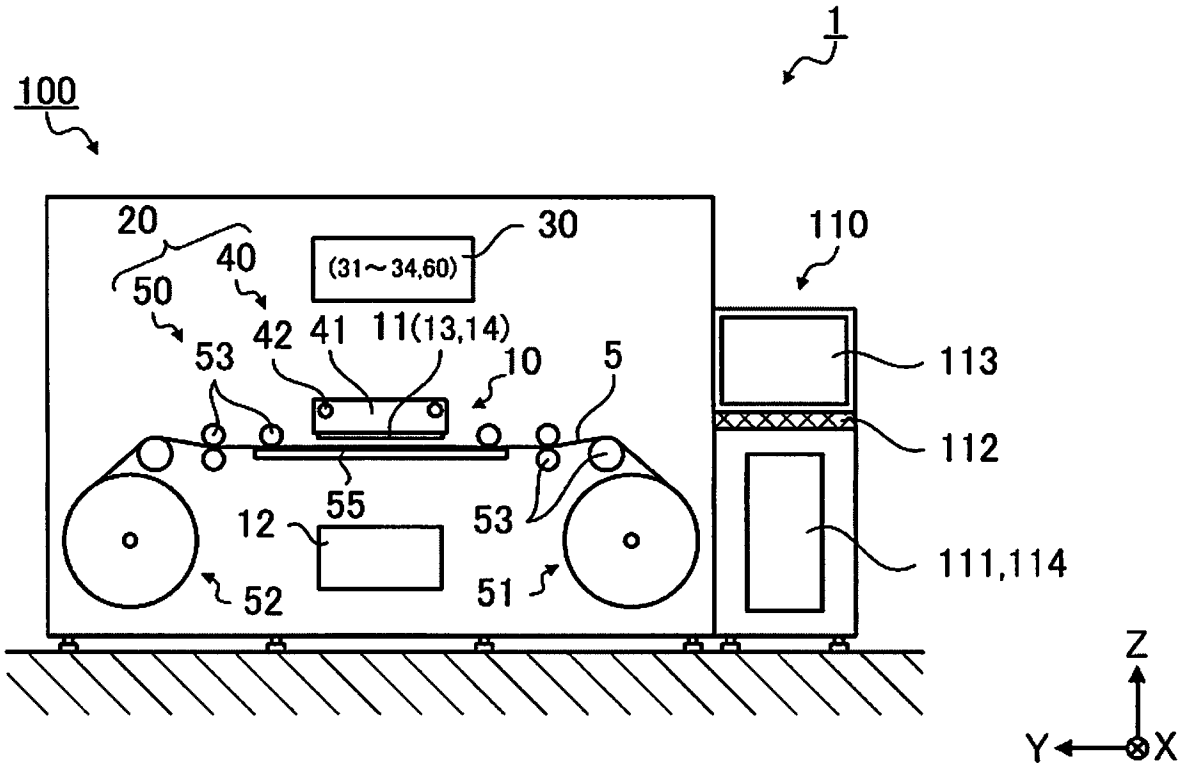
FIG. 1 is a front view illustrating a configuration of a printing system including a recording device according to Exemplary Embodiment 1.

With reference to the drawings, description is given below of exemplary embodiments of the invention. The following is an exemplary embodiment of the invention and is not intended to limit the invention. Note that the drawings may not be illustrated to scale, for illustrative clarity. Furthermore, as for coordinates given in the drawings, it is assumed that a Z-axis direction is an up/down direction, a +Z direction is an upward direction, an X-axis direction is a front/rear direction, a −X direction is a frontward direction, a Y-axis direction is a left/right direction, a +Y direction is a leftward direction, and an X-Y plane is a horizontal plane.

Exemplary Embodiment 1

Figure 2:
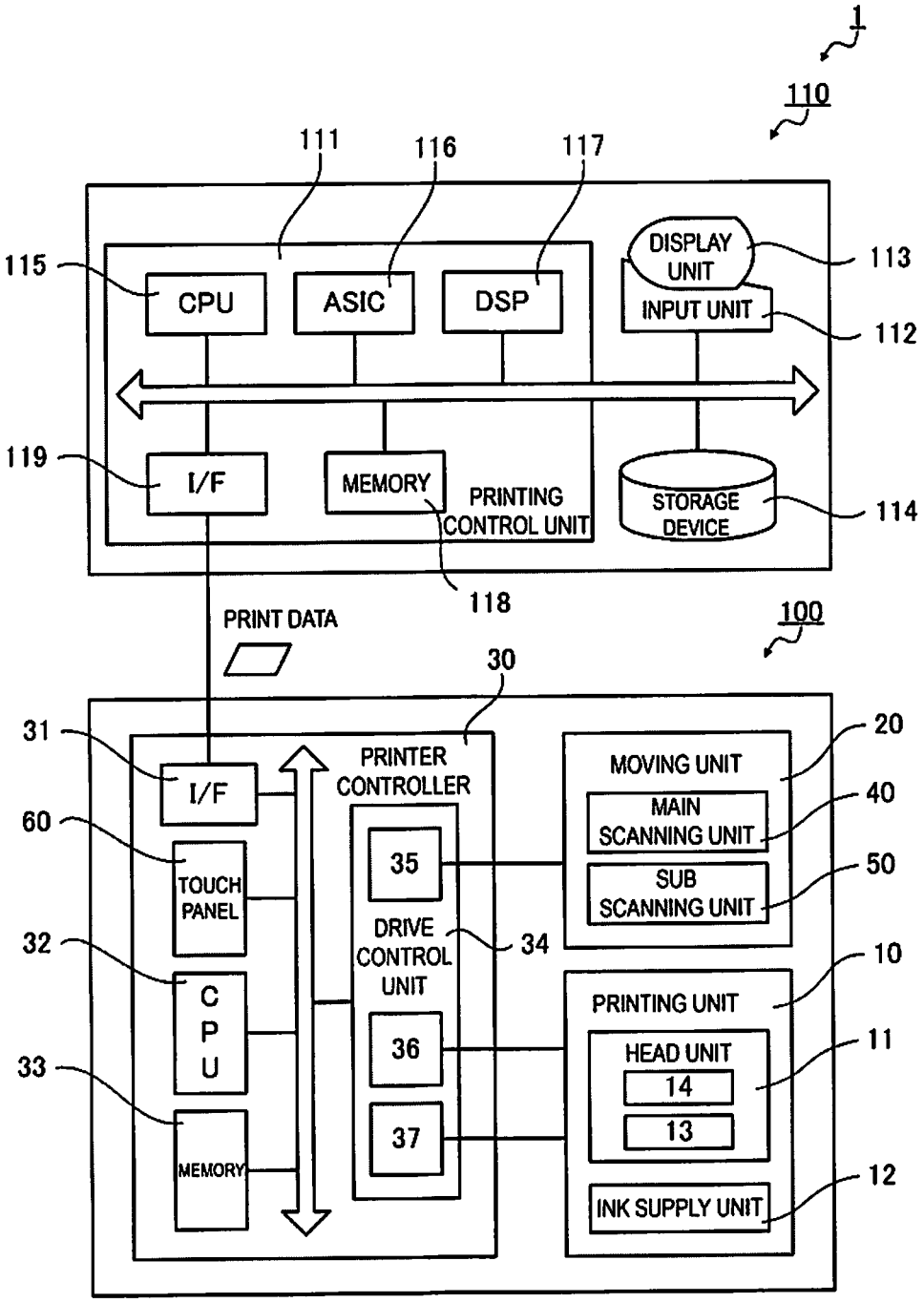
FIG. 2 is a block diagram illustrating the configuration of the printing system including the recording device according to Exemplary Embodiment 1.

FIG. 1 is a front view illustrating a configuration of a printing system 1 including a "recording device" according to Exemplary Embodiment 1, and FIG. 2 is a block diagram of the same. Printing of images, characters, symbols, or the like, which is an aspect of "recording", will be described below. Note that recording includes, besides printing of images, characters, symbols, or the like, recording of digital information by applying droplets to desired positions on a recording medium and application of constituent materials or modeling materials for a product.

The printing system 1 includes a printer 100 used as a "recording apparatus" and an image processing apparatus 110 connected to the printer 100. The printer 100 is an ink-jet serial printer that prints a desired image on a long-length printing medium 5 supplied in a roll shape, based on printing data received from the image processing apparatus 110.

The printing medium 5 to be used may be wood-free paper, cast paper, art paper, coated paper, or synthetic paper, for example. The printing medium 5 is not limited to the papers described above. The printing medium 5 to be used may be a cloth, or a film formed of Polyethylene terephthalate (PET), polypropylene (PP) or the like, for example.

Basic Configuration of Image Processing Apparatus

The image processing apparatus 110 includes a printing control unit 111, an input unit 112, a display unit 113, a storage device 114, and the like, and controls print jobs for printing to be performed by the printer 100. In a preferred example, the image processing apparatus 110 is configured using a personal computer.

Software operated by the image processing apparatus 110 includes general image processing application software (hereinafter referred to as an application) that deals with the image data to be printed, and printer driver software (hereinafter, referred to as a printer driver) that generates printing data for controlling the printer 100 and causing the printer 100 to execute printing.

Here, the image data includes text data and full-color image data, and may be, for example, typical RGB digital image information.

The printing control unit 111 includes a Central Processing Unit (CPU) 115, an Application Specific Integrated Circuit (ASIC) 116, a Digital Signal Processor (DSP) 117, a memory 118, a printer interface (I/F) unit 119, and the like, and performs centralized management of the entire printing system 1.

The input unit 112 is an information input unit serving as a human interface. Specifically, the input unit 112 is, for example, a port or the like for connection to a keyboard, a mouse pointer, or an information input device.

The display unit 113 is an information display unit (display) used as a human interface, and displays information input from the input unit 112, images to be printed on the printer 100, and information related to the print job, and the like, under the control of the printing control unit 111.

The storage device 114 is a rewritable storage medium such as a hard disk drive (HDD) or a memory card, and stores software run by the image processing apparatus 110 (programs run by the printing control unit 111), an image to be printed, information about a print job, and the like.

The memory 118 is a storage medium that secures a region for storing programs run by the CPU 115, a work region for running such programs, and the like, and includes storage elements such as a RAM and an EEPROM.

Basic Configuration of Printer 100

The printer 100 includes a printing unit 10, a moving unit 20, a printer control unit 30 used as a "control unit", and the like. The printer 100 that has received the printing data from the image processing apparatus 110 controls, based on the printing data, the printing unit 10 and the moving unit 20 by the printer control unit 30 to print (form) an image on the printing medium 5.

The printing data is image formation data obtained by converting the image data so that the printer 100 can print the image data using the application and printer driver included in the image processing apparatus 110, and includes a command for controlling the printer 100.

The printing unit 10 includes a head unit 11, an ink supply unit 12, and the like.

The moving unit 20 includes a main scanning unit 40, a sub scanning unit 50, and the like. The main scanning unit 40 includes a carriage 41, a guide shaft 42, a carriage motor (not illustrated), and the like. The sub scanning unit 50 includes a supply unit 51, an accommodation unit 52, a transport roller 53, a platen 55, and the like.

The head unit 11 includes a printing head 13 including a plurality of nozzle rows (heads) each with a plurality of nozzles arranged in rows for discharging printing ink (hereinafter referred to as ink) as "droplets" (ink droplets), and a head control unit 14. The head unit 11 is mounted on the carriage 41, and moves back and forth in a main scanning direction (X-axis direction illustrated in FIG. 1) along with the carriage 41 that moves in the main scanning direction. The head unit 11 (printing head 13) discharges ink droplets onto the printing medium 5 supported by the platen 55 under the control of the printer control unit 30 while moving in the main scanning direction, and thus a plurality of dot rows (raster lines) along the main scanning direction are formed on the printing medium 5.

In the description below, a pass operation or simply a pass refers to an operation of causing the nozzle rows (heads) to move in the main scanning direction, while discharging the inks to form dots. A single pass operation means dot formation involved in single movement in the main scanning direction. By combining, in a sub scanning direction (Y-axis direction illustrated in FIG. 1) intersecting with the main scanning, partial images to be printed through forming of dots along a single movement in the main scanning direction, a desired image based on image data is printed.

The ink supply unit 12 includes an ink tank, and an ink supply path (not illustrated) that supplies ink from the ink tank to the print head 13, and the like.

Examples of the inks include four ink sets obtained by adding black (K) to three ink sets including cyan (C), magenta (M), and yellow (Y), as ink sets of dark ink compositions. Examples of the inks also include eight ink sets obtained by adding ink sets of light ink compositions, such as light cyan (Lc), light magenta (Lm), light yellow (Ly), and light black (Lk), with reduced concentrations of the respective color materials. The ink tank, the ink supply path, and an ink supply route to the nozzles that discharge the same ink are provided separately for each ink.

As for a method of discharging ink droplets (ink-jet method), a piezo method is employed. The piezo method is a printing method, in which a pressure corresponding to a printing information signal is applied to the ink stored in a pressure generation chamber by a piezoelectric element (piezo element), and ink droplets are ejected (discharged) from a nozzle communicating with the pressure chamber.

Note that the method of discharging ink droplets is not limited to the piezo method and may be any other recording technique of ejecting ink in a form of droplets and forming a dot group on a recording medium. For example, the method of discharging ink droplets may be a method in which the ink is continuously ejected in a droplet shape from a nozzle at a strong electric field between the nozzle and an acceleration electrode placed in front of the nozzle, and a printing information signal is supplied from a deflection electrode while the ink droplets are flying for recording, a method (electrostatic attraction method) for ejecting ink droplets in response to the printing information signal without deflection, a method in which the ink droplet is forcibly ejected by applying pressure to the ink by a small pump and mechanically vibrating the nozzle with a quartz oscillator and the like, and a method (thermal jet method) in which the ink is heated to be foamed by a micro electrode according to the printing information signal and the ink droplet is ejected to perform recording, and the like.

The moving unit 20 (the main scanning unit 40 and the sub scanning unit 50) causes the printing medium 5 to relatively move with respect to the printing unit 10 under the control of the printer control unit 30.

The guide shaft 42 extends in the main scanning direction and supports the carriage 41 in a slidable contact state. The carriage motor serves as a drive source to move the carriage 41 back and forth along the guide shaft 42. That is, the main scanning unit 40 (the carriage 41, the guide shafts 42, and the carriage motor) causes the carriage 41 (that is, the printing head 13) to move in the main scanning direction along the guide shafts 42 under the control of the printer control unit 30.

The supply unit 51 rotatably supports a reel on which the printing medium 5 is wound into a roll, and the supply unit 51 feeds the printing medium 5 into the transport path. The accommodation unit 52 rotatably supports a reel, on which the printing medium 5 is wound, and reels off the printing medium 5, on which printing is completed, from the transport path.

The transport roller 53 includes a driving roller that causes the printing medium 5 to move in the sub scanning direction on an upper surface of the platen 55, a driven roller that rotates in accordance with the movement of the printing medium 5, and the like and constitutes the transport path through which the printing medium 5 is transported from the supply unit 51 to the accommodation unit 52 via a printing area (the area where the printing head 13 moves on the upper surface of the platen 55 in the main scanning direction) of the printing unit 10.

The printer control unit 30 includes an interface unit 31, a CPU 32, a memory 33, a drive control unit 34, a touch panel 60 used as an "input unit", and the like, and controls the printer 100.

The interface unit 31 is connected to the printer interface unit 119 of the image processing apparatus 110 to transmit and receive data between the image processing apparatus 110 and the printer 100.

The CPU 32 is an arithmetic processing unit for overall control of the printer 100.

The memory 33 is a storage medium that secures a region for storing programs run by the CPU 32, a work region for running such programs, and the like, and includes storage elements such as a RAM and an EEPROM.

The CPU 32 controls the printing unit 10 and the moving unit 20 through the drive control unit 34 according to the program stored in the memory 33 and the printing data received from the image processing apparatus 110.

The touch panel 60 is an information input/output unit used as a human interface capable of inputting operation instruction information to the printer 100 (printer control unit 30) and displaying various results of image processing from the printer control unit 30 (CPU 32).

The drive control unit 34 includes firmware configured to operate based on the control of the CPU 32, and controls driving of the printing unit 10 (head unit 11, and ink supply unit 12), and the moving unit 20 (main scanning unit 40, and sub scanning unit 50). The drive control unit 34 includes drive control circuits including a moving control signal generation circuit 35, a discharge control signal generation circuit 36, a drive signal generation circuit 37, and the like, a ROM and a flash memory (not illustrated) incorporating firmware controlling the drive control circuits, and the like.

The moving control signal generation circuit 35 is a circuit that generates a signal for controlling the moving unit 20 (the main scanning unit 40 and the sub scanning unit 50) based on the print data according to an instruction from the CPU 32.

The discharge control signal generation circuit 36 is a circuit that generates a head control signal for selecting the nozzles for discharging the inks, selecting the amount to be discharged, controlling the discharge timing, and the like, based on the printing data in accordance with instructions from the CPU 32.

The drive signal generation circuit 37 is a circuit that generates drive waveforms (drive signals COM) driving a pressure generating unit 72 included in the printing head 13. The pressure generating unit 72 and the drive signals COM will be described below.

Nozzle Rows (Heads)

Figure 3:
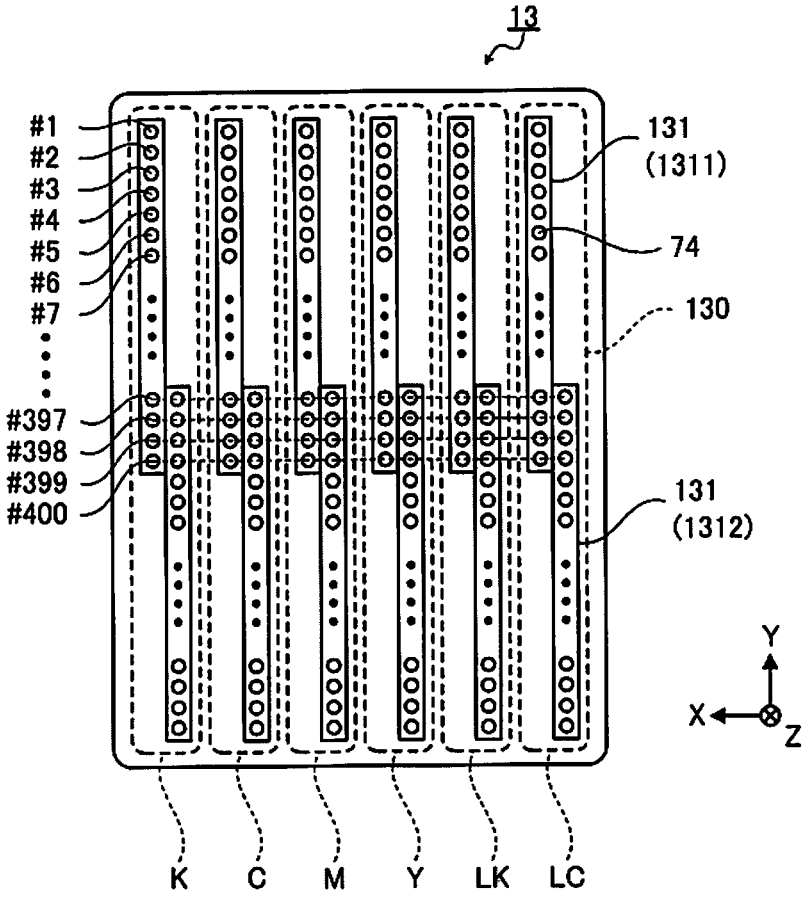
FIG. 3 is a schematic view illustrating an example of an array of nozzles.

FIG. 3 is a schematic diagram illustrating an example of arrangement of the nozzles when viewed from a lower surface of the printing head 13.

The printing head 13 includes six nozzle groups 130 from which six color inks (black K, cyan C, magenta M, yellow Y, gray LK, and light cyan LC) are discharged. Each of the nozzle groups 130 includes two heads 131 (head 1311 and head 1312) discharging inks in the same color. The head 1311, one of the two heads 131 constituting the nozzle group 130, corresponds to a "first nozzle row" described below, and the head 1312, the other of the two heads 131, corresponds to a "second nozzle row".

The head 131 includes a nozzle row including 400 nozzles 74 #1 to #400 arranged in a row at regular intervals (nozzle pitches) along the sub scanning direction (Y-axis direction).

As illustrated by dashed lines in FIG. 3, in each of the nozzle groups 130, the heads 131 overlap in the X-axis direction such that four nozzles 74 in an end region of one of the heads 131 share, in the Y axis direction, the same positions on a Y axis with four nozzles 74 in a corresponding end region of the other head 131.

The head 131 is manufactured by, for example, a Micro Electro Mechanical Systems (MEMS) manufacturing process involving application of a semiconductor process, using a silicon wafer as a basic material. The nozzles 74 included in the head 131 constitute a nozzle group having the same or similar ink discharge characteristics.

Figure 4:
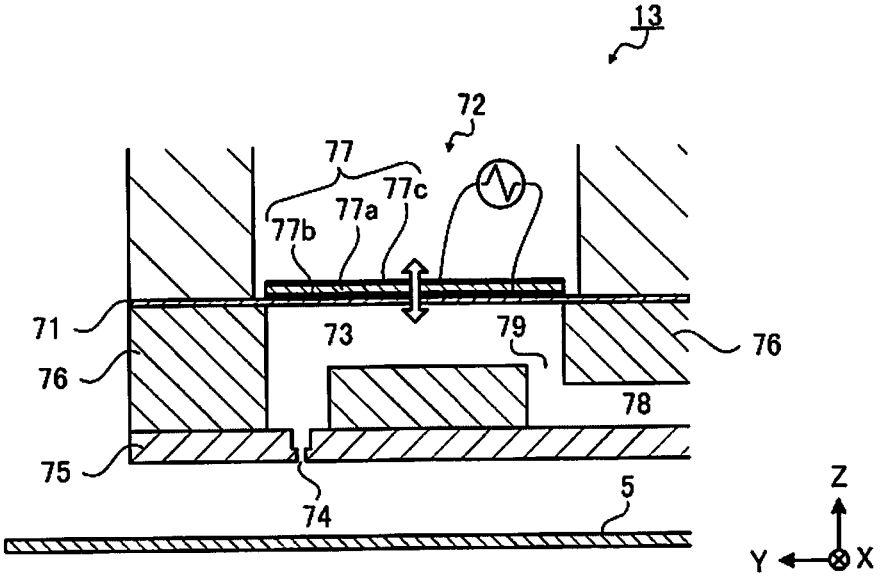
FIG. 4 is a cross-sectional view of a main part of a printing head.

FIG. 4 is a cross-sectional view of a main part of the printing head 13.

The printing head 13 includes the nozzles 74 discharging the inks and pressure generating units 72 provided in association with the respective nozzles 74.

Each of the pressure generating units 72 includes a cavity 73 used as a pressure generating chamber, a vibration plate 71, an actuator 77, and the like.

The cavity 73 communicates with the nozzle 74 and is internally filled with the ink.

The vibration plate 71 constitutes at least a part of surfaces constituting the cavity 73 (constituting a top surface of the cavity 73 in the example illustrated in FIG. 4). Displacement (bending) of the vibration plate 71 increases or reduces the volume of the cavity 73 (in other words, the internal pressure of the cavity 73).

The actuator 77 includes a piezoelectric thin film 77*a* (piezo element), an electrode 77*b* provided to cover one of a front surface and a back surface of the piezoelectric thin film 77*a*, an electrode 77*c* provided to cover the other of the front and back surfaces of the piezoelectric thin film 77*a*, and the like. The actuator 77 is layered on the vibration plate 71, with the vibration plate 71 located between the actuator 77 and the cavity 73. A voltage is applied between the electrode 77*b* and the electrode 77*c* to deform the piezoelectric thin film 77*a* (piezo element), thus allowing the vibration plate 71 to be bent (bent and vibrated).

The nozzles 74 are formed in a nozzle plate 75. Furthermore, a cavity substrate 76 located between the nozzle plate 75 and the vibration plate 71 is provided with the cavity 73 and a reservoir 78 that is in communication with the cavity via an ink supplying port 79. The reservoir 78 is in communication with an ink tank (not illustrated) via the ink supply path.

Drive signals (drive signals COM) changing a voltage level (potential) between the electrodes 77*b* and 77*c* are applied to the pressure generating unit 72 configured as described above to bend and vibrate the vibration plate 71 as illustrated by an arrow in FIG. 4. This allows the pressure inside the cavity 73 to be changed to vibrate the ink inside the cavity 73 and enables ink droplets to be discharged from the nozzles 74.

According to the configuration described above, the printer control unit 30 forms (prints) a desired image on the printing medium 5 by repeating, with respect to the printing medium 5 supplied to the printing area by the sub scanning unit 50 (supply unit 51, and transport roller 53), an operation of discharging ink droplets from the printing head 13 while moving, in the main scanning direction (X-axis direction), the carriage 41 that supports the printing head 13 along the guide shaft 42, and an operation of moving the printing medium 5 in the sub scanning direction (+Y-axis direction) intersecting with the main scanning direction by the sub scanning unit 50 (transport roller 53).

Basic Function of Printer Driver

Figure 5:
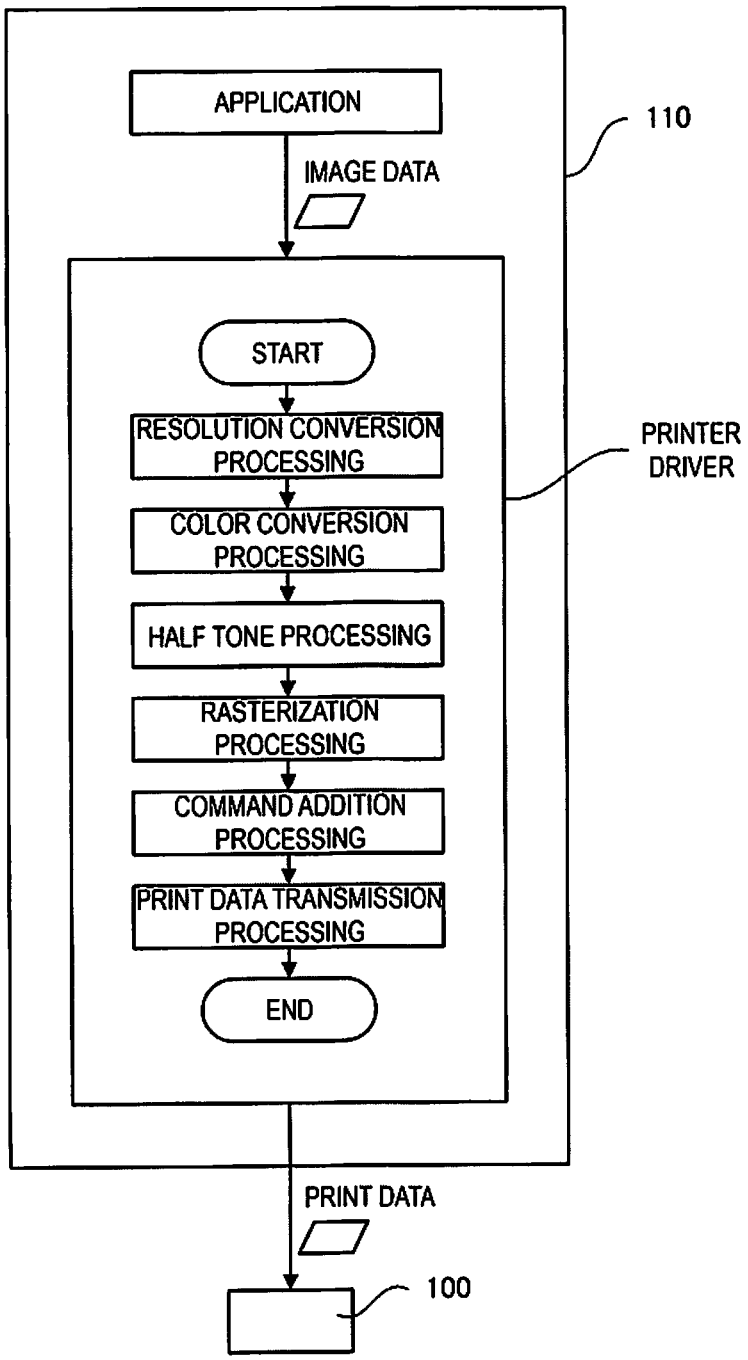
FIG. 5 is an explanatory view of basic functions of a printer driver.

FIG. 5 is an explanatory view of basic functions of the printer driver.

Printing on the printing medium 5 is started by transmitting printing data to the printer 100 from the image processing apparatus 110. The printing data is generated by the printer driver.

With reference to FIG. 5, description is given below of processing of generating print data.

The printer driver receives image data from the application, converts the image data into print data in a format that can be interpreted by the printer 100, and then outputs the print data to the printer 100. For the conversion of the image data from the application into the print data, the printer driver performs resolution conversion processing, color conversion processing, halftone processing, rasterization processing, command addition processing, and the like.

The resolution conversion processing is processing of converting the image data output from the application into a resolution for printing (printing resolution) on the printing medium 5. For example, when the printing resolution is specified as 720×720 dpi, vector format image data received from the application is converted into bit map format image data having a 720×720 dpi resolution. Each pixel data in the image data after the resolution conversion processing includes pixels arranged in a matrix pattern. Each pixel has a gray scale value in 256 gray scale levels, for example, in the RGB color space. That is, each piece of the pixel data after the resolution conversion shows the gray scale value of the corresponding pixel.

Among the pixels arranged in the matrix pattern, the pixel data corresponding to one row of pixels aligned in a predetermined direction is called raster data. Note that the predetermined direction in which the pixels corresponding to the raster data are aligned corresponds to the direction (the main scanning direction) in which the printing head 13 moves when printing an image.

The color conversion processing is processing of converting RGB data into data of a CMYK color system space. CMYK refers to cyan (C), magenta (M), yellow (Y), and black (K). The image data of the CMYK color system space is data corresponding to the colors of the ink of the printer 100. Accordingly, in a case where the printer 100 uses eight types of ink of the CMYK color system, the printer driver generates image data in an eight-dimensional space of the CMYK color system based on the RGB data.

This color conversion processing is performed based on a table (color conversion look-up table) in which the gray scale values of the RGB data and the gray scale values of the CMYK color system data are associated with each other. Note that the pixel data after the color conversion processing is the CMYK color system data of 256 gray scales, for example, expressed in the CMYK color space.

The half tone processing is a process of converting data of a high number of gray scale levels (256 gray scale levels) into data of a number of gray scale levels that can be formed by the printer 100. Through this half tone processing, data expressing 256 gray scale levels, for example, is converted into 1-bit data expressing two gray scale levels (dot and no dot) and 2-bit data expressing four gray scale levels (no dot, small dot, medium dot, and large dot). Specifically, a dot generation rate corresponding to the gray scale value (in the case of four gray scale levels, a generation rate of each of no dot, small dot, medium dot, and large dot, for example) is obtained from a dot generation rate table in which the gray scale values (0 to 255) and dot generation rates are associated with each other. Then, with the generation rate thus obtained, pixel data is created so that dots are formed in a distributed manner, by using a dither method, an error diffusion method, or the like.

The rasterization processing is processing of rearranging the pixel data (for example, the 1-bit or 2-bit data as described above) in the matrix pattern, according to a dot formation order for printing. The rasterization processing includes pass allocation processing of allocating the image data including the pixel data after the half tone processing to each pass in which the printing head 13 discharges ink droplets while moving in the main scanning direction. Once the pass allocation processing is completed, the actual nozzles that form respective raster lines constituting the print image are allocated.

The command addition processing is a process of adding command data corresponding to a printing method, to the rasterized data. The command data includes, for example, sub scanning data related to sub scanning specifications (moving distance and speed on the upper surface of the platen 55 in the sub scanning direction, and the like) of the medium, and the like.

The sequence of processing by the printer driver is performed by the ASIC 116 and the DSP 117 (refer to FIG. 2) under the control of the CPU 115. Then, the printing data generated by the sequence of processing is transmitted by printing data transmission processing to the printer 100 through the printer interface unit 119.

Driving Control of Printing Head in Related Art

Figure 6:
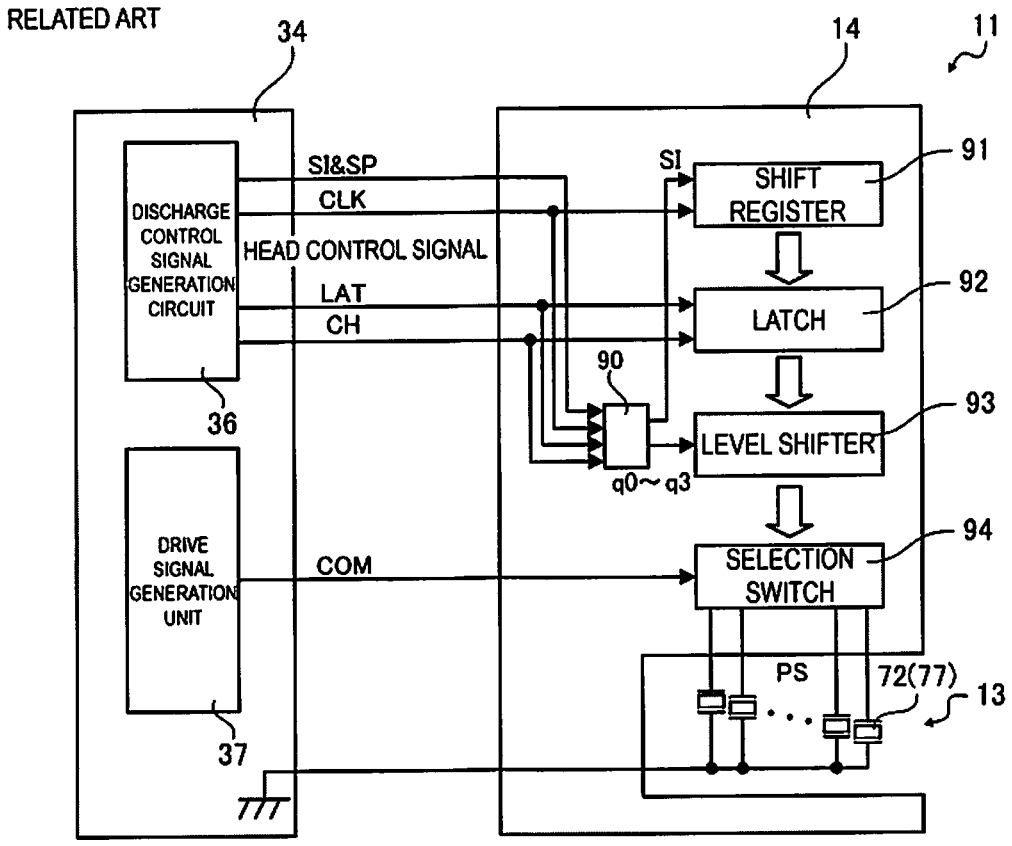
FIG. 6 is a block diagram illustrating an example of a configuration of a drive control system in the related art.

Now, with reference to FIG. 6, driving control of the printing head 13 in the related art will be described. FIG. 6 is a block diagram illustrating an example of a configuration of a drive control system driving the printing head 13 in the related art.

As described above, the head unit 11 includes the printing head 13, the head control unit 14, and the like. Furthermore, the drive control unit 34 includes a discharge control signal generation circuit 36 and a drive signal generation circuit 37 to controllably drive the printing head 13 via the head control unit 14.

More specifically, the drive control unit 34 selectively drives, via the head control unit 14, the pressure generating unit 72 (actuator 77) corresponding to each nozzle 74 based on head control signals generated by the discharge control signal generation circuit 36 and the drive signals COM generated by the drive signal generation circuit 37.

The drive signals COM are basic drive signals used by the head control unit 14 to change the level of a voltage to be applied and drive the actuator 77. The drive signals COM thus change the pressure in the ink inside the cavity 73 to cause the ink to be discharged from the nozzle 74. In other words, the level of each of the drive signals COM (here, the applied voltage level) is changed and the resultant drive signal COM is applied to the actuator 77 to enable a prescribed amount of ink to be discharged from the nozzle 74.

Examples of the head control signals include drive pulse selection data SI&SP, a clock signal CLK, a latch signal LAT, and a channel signal CH.

The drive pulse selection data SI&SP includes pixel data SI specifying the actuator 77 corresponding to the nozzle 74 from which ink droplets are to be discharged, and waveform pattern data SP for the drive signal COM regarding the discharge amount.

The latch signal LAT and the channel signal CH are control signals specifying timings for the drive signal COM. The latch signal LAT causes output of the series of drive signals COM to be started, and a drive pulse PS is output for each channel signal CH.

Ink Discharge Driving

Driving for discharging the inks will now be described.

As illustrated in FIG. 6, the head control unit 14 includes a control circuit 90, a shift register 91, a latching circuit 92, a level shifter 93, a selection switch 94, and the like.

The head control unit 14 causes the control circuit 90 to generate waveform selection signals q0 to q3 (see FIG. 7) from the head control signal received from the drive control unit 34 (discharge control signal generation circuit 36). The waveform selection signals q0 to q3 are generated based on the waveform pattern data SP and the timing signals such as the clock signal CLK, the latch signal LAT, and the channel signal CH. Description of steps for generating the waveform selection signals q0 to q3 is omitted.

The pixel data SI is sequentially input to the shift register 91, and storage regions in the shift register 91 is sequentially shifted to a succeeding stage starting with a first stage, in response to an input pulse of the clock signal CLK. After an amount of the pixel data SI corresponding to the number of nozzles is stored in the shift register 91, the latching circuit 92 uses the input latch signal LAT to latch output signals from the shift register 91. The signals saved in the latching circuit 92 are converted by the level shifter 93 into voltage levels allowing the succeeding selection switch 94 to be turned on/off (connect/cutoff). When an output from the level shifter 93 turns on the selection switch 94, the drive signals COM are connected to the actuator 77. In other words, drive pulses PS are applied to the actuator 77.

Figure 7:
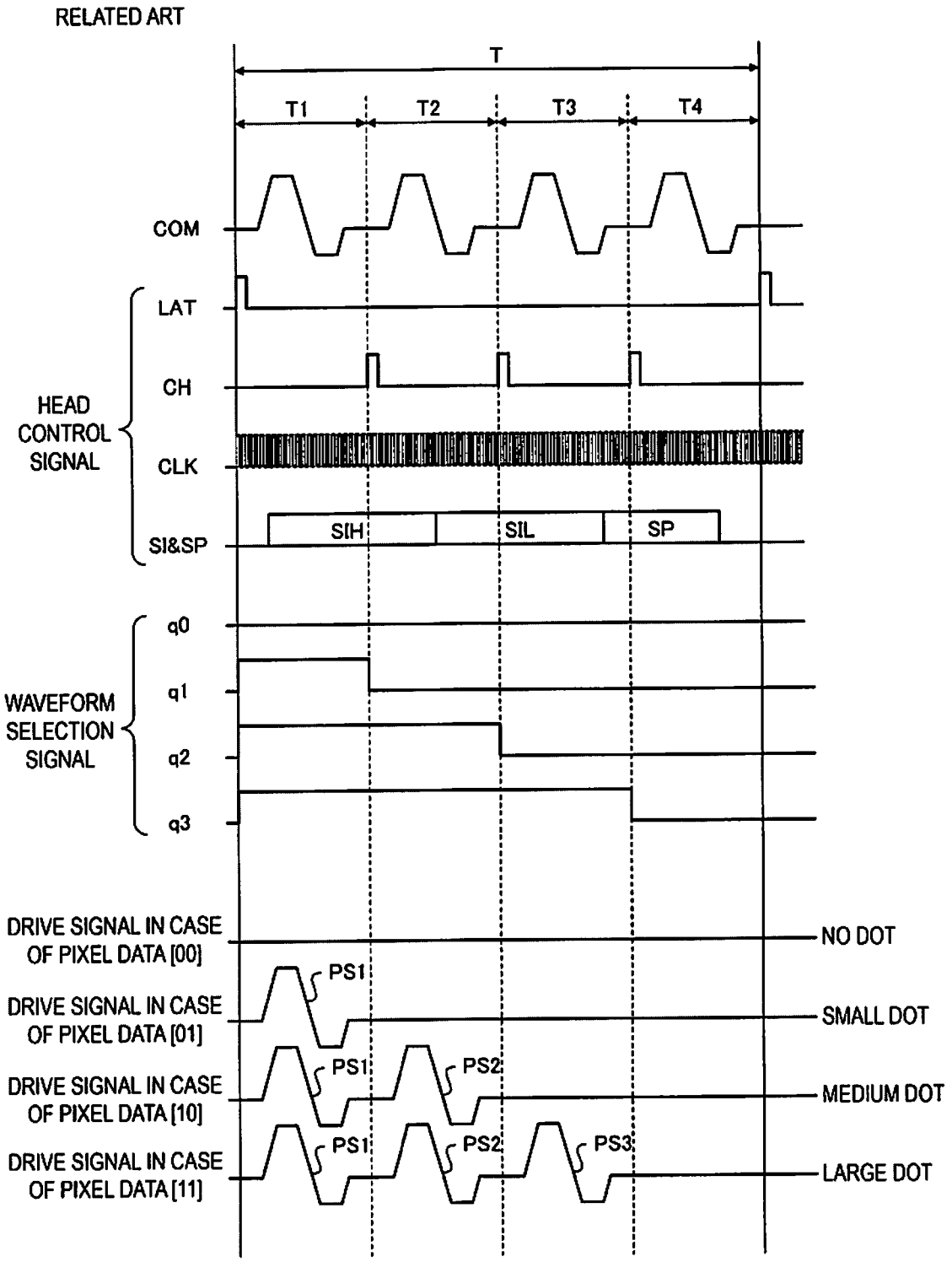
FIG. 7 is a timing chart illustrating drive signals causing ink to be discharged.

FIG. 7 is a timing chart illustrating drive signals for causing the inks to be discharged. Drive pulses PS1 to PS3 illustrated in FIG. 7 are drive signals (drive waveforms) applied to the actuator 77 and represent signals (signals based on the drive signals COM) for causing ink droplets to be discharged. Furthermore, in FIG. 7, a period T corresponding to a cycle period (hereinafter also referred to as the period T) corresponds to a period during which the nozzle 74 moves by one pixel in the main scanning direction. For example, for a printing resolution of 720 dpi, the period T corresponds to a period during which the nozzle 74 moves 1/720 of an inch with respect to the printing medium 5.

The head control unit 14 applies signals (drive pulses PS1 to PS3) included in the drive signals COM and causing the inks to be selectively discharged, to the actuator 77 in accordance with the drive pulse selection data SI&SP and the waveform selection signals q0 to q3. In other words, the waveform selection signals q0 to q3 are used to selectively apply the drive signals COM (drive pulses PS1 to PS3) to discharge ink droplets with different sizes into one pixel, expressing a plurality of gray scale levels.

Specifically, as illustrated in FIG. 7, when a large dot is formed (2-bit pixel data (dot gray scale value) is [11]), during periods T1 to T3, the waveform selection signal q3 is used to select and apply corresponding drive signals COM (in other words, the drive pulse PS1, the drive pulse PS2, and the drive pulse PS3) to the actuator 77 (piezoelectric thin film 77*a*).

When a medium dot is formed (the dot gray scale value is [10]), during the periods T1 to T2, the waveform selection signal q2 is used to select and apply corresponding drive signals COM (in other words, the drive pulse PS1 and the drive pulse PS2) to the actuator 77.

When a small dot is formed (the dot gray scale value is [01]), during the period T1, the waveform selection signal q1 is used to select and apply corresponding drive signal COM (in other words, the drive pulse PS1) to the actuator 77.

When no dot is formed (the dot gray scale value is [00]), during the period T, the waveform selection signal q0 is used to prevent selection from the drive signals COM. Accordingly, no signal for causing the inks to be discharged is applied to the actuator 77.

The drive signals COM (drive pulses PS1 to PS3) each include a waveform including a trapezoidal wave. The drive signals COM (drive pulses PS1 to PS3) each need to accurately control the timing to discharge ink droplets and the amount of ink discharged during a single discharge. The drive signals COM thus each include a trapezoidal wave, in other words, a waveform allowing the output value of the waveform to be changed over time.

In the related-art recording device including the basic configuration described above, a manufacturing variation may cause a difference (variation) in discharge characteristics for discharging inks between the two heads 131 constituting the nozzle group 130 (see FIG. 3), degrading recording (printing) quality. In contrast, in particular, in a case where the amount of discharged ink droplets varies between the heads 131 (discharging of the same amount of ink droplets fails in spite of application of the same drive signal COM), the recording device can be configured to allow independent control of the voltage level of the drive signal COM applied to each head 131. This allows the voltage level to be corrected according to the degree of the difference (variation) in discharge characteristics (discharge amount), thus suppressing the difference (variation).

However, for such correction, the discharge characteristics (the degree of a variation in the amount of discharged ink droplets) of all the heads 131 need to be preliminarily measured and determined. Furthermore, the recording device needs to be preliminarily corrected according to the degree of the variation in the determined discharge characteristics of the individual heads 131 (the voltages of the drive signals COM needed to correct the variation need to be adjusted). Alternatively, the recording device needs to be configured to store the degree of the variation in the preliminarily determined discharge characteristics of the individual heads 131 to allow for correction corresponding to the degree.

In contrast, in the recording device (printer 100) of the present embodiment, the two heads 131 constituting the nozzle group 130 are configured to be capable of being driven at independent voltages. The recording device is also configured to receive "selection information" determined and selected by the user while viewing images printed using the respective heads 131 (comparing densities of the images) to correct the variation in discharge characteristics of the individual heads 131 (the variation is corrected by accepting a user's input). In other words, an image to be printed can be corrected without preliminary measurement or determination of the discharge characteristics (the degree of the variation in the amount of discharged ink droplets) of all the heads 131.

Details will be described below.

Driving Control of Printing Head

Figure 8:
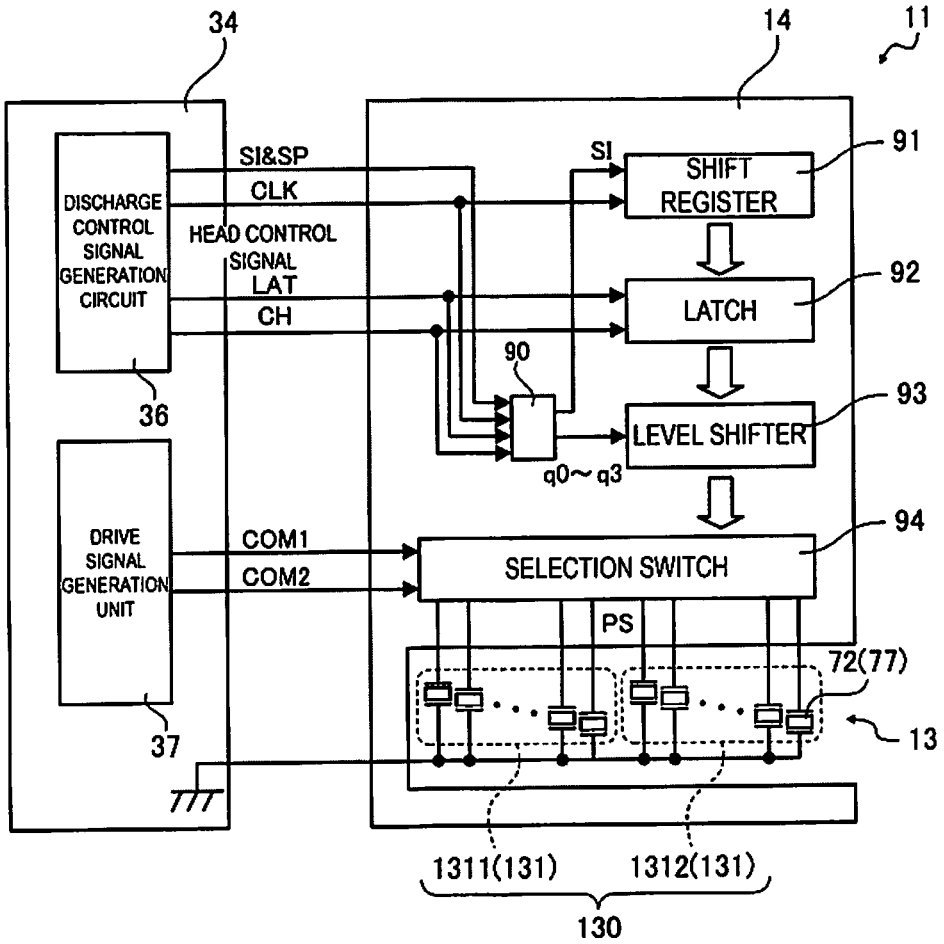
FIG. 8 is a block diagram illustrating an example of a configuration of a drive control system included in the recording device according to Exemplary Embodiment 1.

FIG. 8 is a block diagram illustrating an example of a configuration of a drive control system driving the printing head 13 in the present embodiment.

A difference from the configuration of the drive control system in the related art described with reference to FIG. 6 lies in that the two heads 131 (the head 1311, used as a "first nozzle row", and the head 1312, used as a "second nozzle row". See FIG. 3) constituting the nozzle group 130 can be independently driven. Specifically, the drive signal generation circuit 37, provided in the drive control unit 34 as a "driving circuit", is configured to independently supply, to the head control unit 14, two drive signals: a drive signal COM1 driving the head 1311 and a drive signal COM2 driving the head 1312. The drive signal COM1 supplied to the head control unit 14 is transmitted to the selection switch 94 driving the pressure generating unit 72 (actuator 77) constituting the head 1311. The drive signal COM2 supplied to the head control unit 14 is transmitted to the selection switch 94 driving the pressure generating unit 72 (actuator 77) constituting the head 1312.

Figure 9:
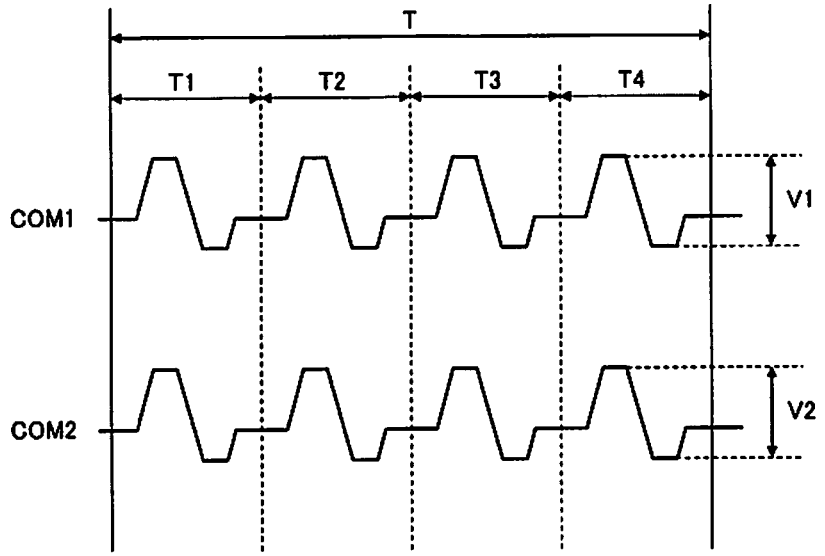
FIG. 9 is a timing chart illustrating drive signals driving a first nozzle row and a second nozzle row.

FIG. 9 is a timing chart illustrating the drive signal COM1 and the drive signal COM2.

As illustrated in FIG. 9, the drive signal COM1 and the drive signal COM2 are the same, in terms of timing and waveform, as the drive signals COM described with reference to FIG. 7, but differ from the drive signals COM only in peak value (drive voltage). In other words, as illustrated in FIG. 9, the drive signal generation circuit 37 uses a drive voltage V1 as a "first voltage" to drive the head 1311 and uses a drive voltage V2 as a "second voltage" to drive the head 1312.

Figure 10:
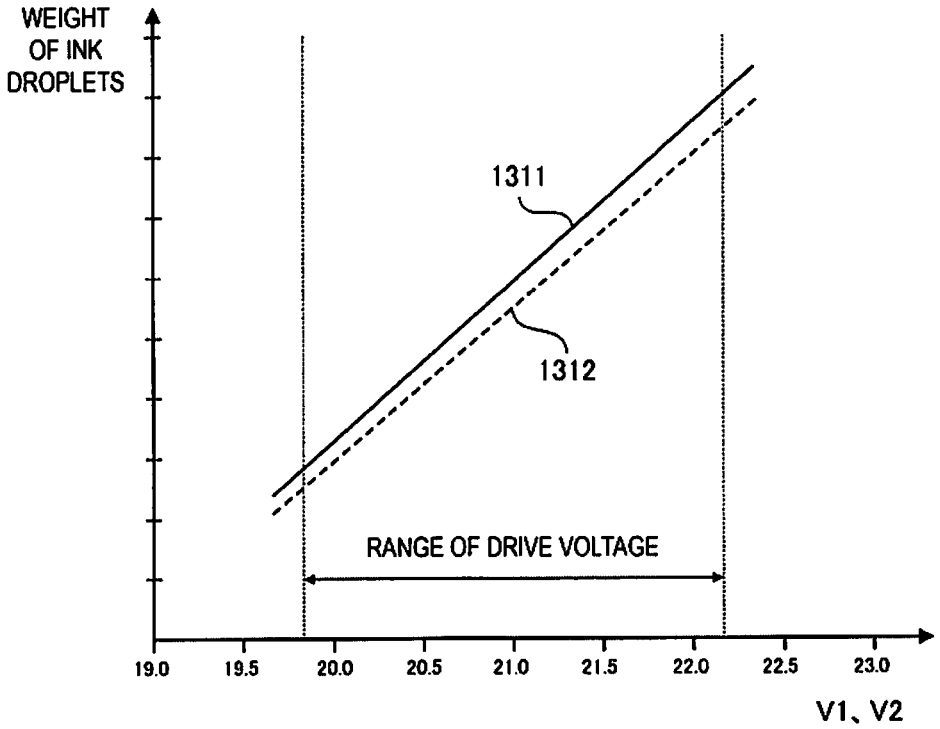
FIG. 10 is a graph illustrating a relation between voltage levels of drive signals driving the first nozzle row and the second nozzle row and a weight of ink droplets discharged from nozzles included in each of the nozzle rows.

FIG. 10 is a graph illustrating an example of a relationship between the drive voltages V1 and V2 and the weight of ink droplets discharged by the nozzles 74 included in the head 1311 and the head 1312.

As illustrated in FIG. 10, within a prescribed range of the drive voltage of the drive signals COM1 and COM2, the weight of ink droplets discharged from the nozzles 74 increases as the drive voltage increases. However, the weight of discharged ink droplets may differ between the head 1311 and the head 1312 due to a manufacturing variation and the like. As a result, in a case where the head 1311 and the head 1312 are caused to print the same image, printing density differs between the head 1311 and the head 1312.

Figure 11:
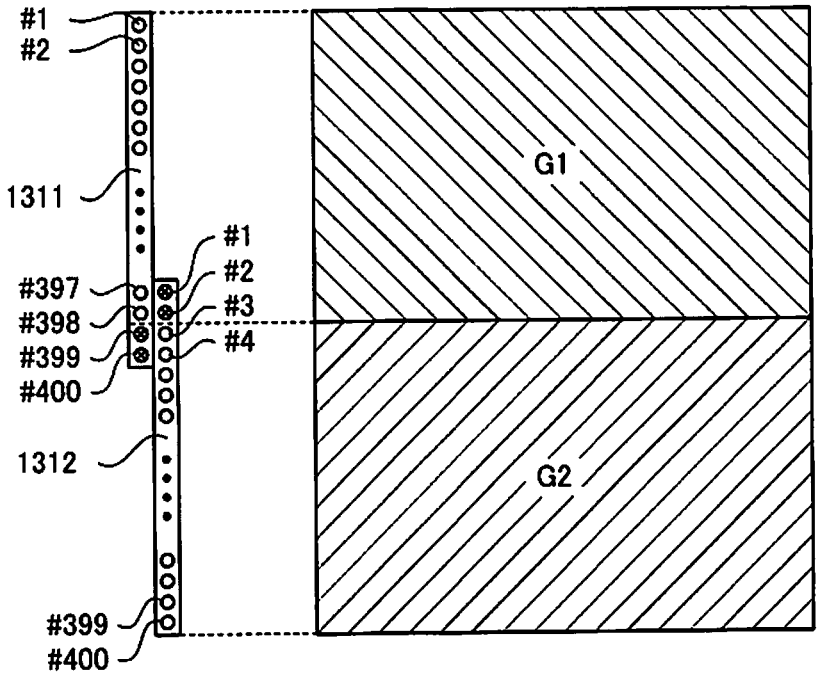
FIG. 11 is a conceptual drawing illustrating an example of a first recording image recorded using the first nozzle row and an example of a second recording image recorded using the second nozzle row.

FIG. 11 is a conceptual drawing illustrating an example of a print image G1 used as a "first recording image" printed using the head 1311 and an example of a print image G2 used as a "second recording image" printed using the head 1312.

In the example illustrated in FIG. 11, the print image G1 and the print image G2 are images printed by the same pass. The print image G1 is printed using nozzles 74 #1 to #398 of the nozzles 74 included in the head 1311. The print image G2 is printed using nozzles 74 #3 to #400 of the nozzles 74 included in the head 1312.

The print image G1 and the print image G2 are printed adjacently to each other in this manner to enable the degree of a difference in printing density to be visually recognized.

The print image G1 and the print image G2 are preferably, for example, solid patterns in which a medium dot is formed at all dot formation positions for each of the nozzle groups 130 (for each color).

Note that the print image G1 and the print image G2 are not necessarily printed by the same pass and that a region where the print image G1 and the print image G2 are adjacent to each other on the Y axis need not necessarily be printed by the nozzles 74 adjacent to one another on the Y axis. That is, the print image G1 and the print image G2 may be printed by a plurality of passes including an operation of moving the printing medium 5 in the sub scanning direction so long as the print image G1 printed using the nozzles 74 of the head 1311 and the print image G2 printed using the nozzles 74 of the head 1312 are printed adjacent 1 to each other.

In the present embodiment, the printer 100, configured as described above, prints the print image G1 and the print image G2 adjacent to each other under the control of the printer control unit 30; the print image G1 is printed using the head 1311, and the print image G2 is printed using the head 1312.

Furthermore, the printer 100 accepts, through a touch panel 60 used as the "input unit", "selection information" obtained by prompting the user to compare the print image G1 with print images G2 formed by the drive voltage V2 with a plurality of levels and to select the selection information based on a result of the comparison (the selection information is information indicative of the level at which the smallest difference in density between the print image G1 and the print image G2 is recognized).

Furthermore, the printer control unit 30 controls the drive voltage V1 and the drive voltage V2 for execution of printing based on the accepted selection information.

Furthermore, the printer 100 stores the selection information input from the touch panel 60 in the memory 33 used as the "storage unit". Note that the "storage unit" is preferably a nonvolatile storage element included in the memory 33.

In other words, the printer 100 of the present embodiment includes the head 1311 including the plurality of nozzles 74 discharging ink droplets and the head 1312 including the plurality of nozzles 74 discharging ink droplets in a color identical to the color of the ink droplets discharged from the nozzles 74 of the head 1311, the drive signal generation circuit 37 configured to drive the head 1311 by the drive voltage V1 and driving the head 1312 by the drive voltage V2, the touch panel 60 configured to accept the input of the selection information selected based on the comparison between the print image G1 printed using the head 1311 and a plurality of the print images G2 printed using the head 1312 while changing the drive voltage V2 for each of the plurality of print images G2, and the printer control unit 30 configured to control the drive voltage V1 and the drive voltage V2 based on the selection information input from the touch panel 60. Furthermore, the printer 100 includes the memory 33 configured to store the selection information input from the touch panel 60.

More specific examples will be described below.

Example 1

In the present example, a drive control system driving the printing head 13 is configured to independently control all the drive voltages for the two heads 131 (head 1311 and head 1312) included in each of the six nozzle groups 130. That is, the drive signal generation circuit 37 delivers 12(=2×6 colors) drive signals COM in total to the head control unit 14 to supply two drive signals (drive signal COM1 and drive signal COM2) to each of the nozzle groups 130 (for each color).

Furthermore, the comparison between the print image G1 formed by the drive voltage V1 and the print images G2 formed by the drive voltage V2 with the plurality of levels can be executed for each color (for each of the nozzle groups 130). The "selection information" selected based on the result of the comparison is also accepted for each color.

Figure 12:
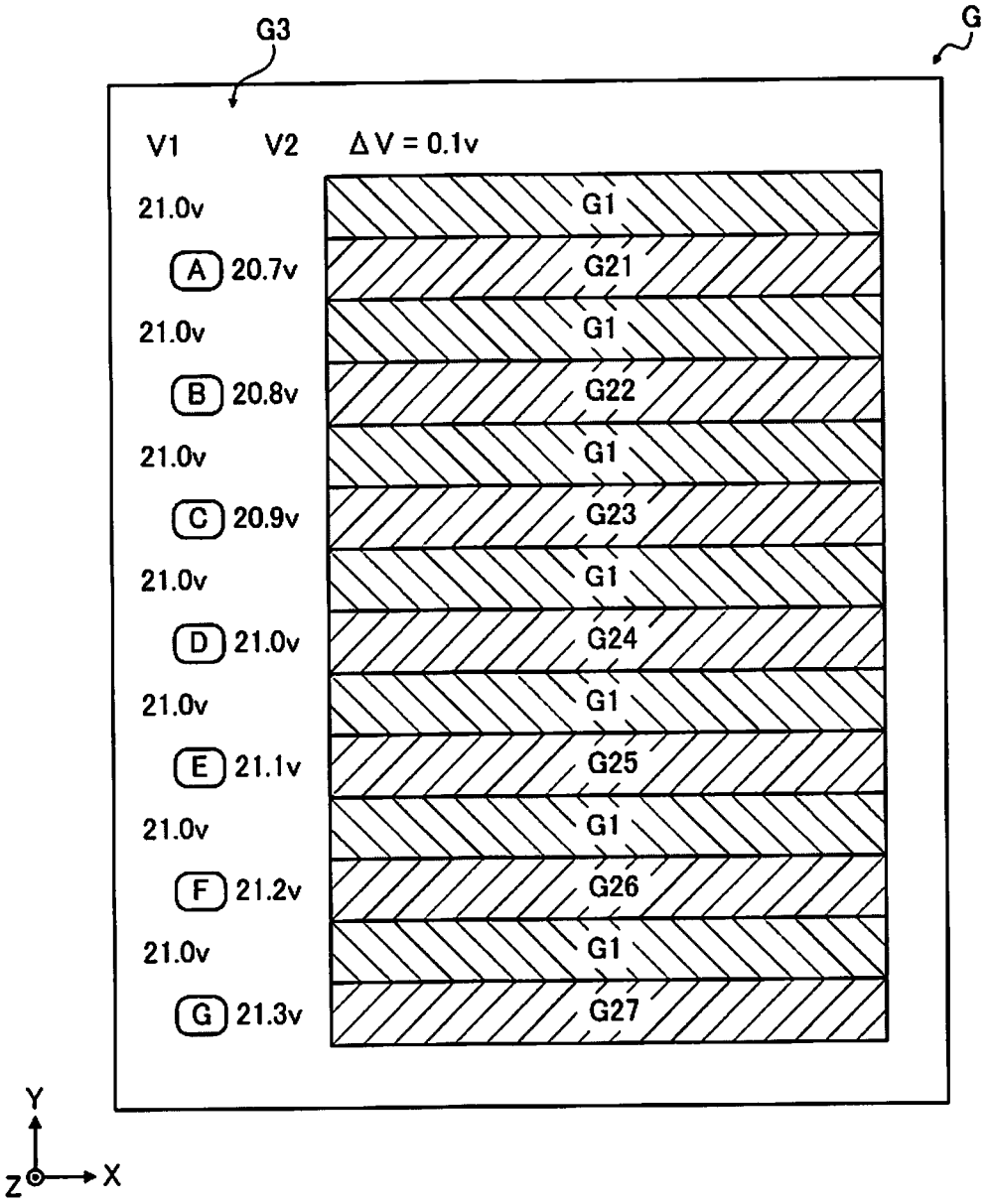
FIG. 12 is a conceptual drawing illustrating an example of a recording image for comparison between a first recording image and second recording images in Example 1.

FIG. 12 is a conceptual drawing illustrating an example of a print image G for comparison between the print image G1 and the print image G2. FIG. 12 illustrates the print image G in one of the six colors (black K, cyan C, magenta M, yellow Y, gray LK, and light cyan LC). A similar print image G is printed as needed for each color to be corrected.

The print image G includes the print image G1, the print images G2 (G21 to G27), and additional information display G3.

The print image G1 is an image printed by the drive signal COM1 driven at the drive voltage V1, using the nozzles 74 included in the head 1311. The print image G1 includes seven (corresponding to the number of levels of the drive voltage V2) reed-shaped solid patterns extending over a prescribed width in the main scanning direction (X-axis direction).

The print images G2 include images printed by the drive signal COM2 driven at the drive voltage V2, using the nozzles 74 included in the head 1312, and specifically include seven print images G21 to G27 printed by the drive voltage V2 with seven levels ranging from 20.7 V to 21.3 V. The seven levels of the drive voltage V2 are the levels of the drive voltage V2 set using seven differential voltages that are integral (i=−3 to +3) multiples of ΔV (=0.1V) used as a "prescribed differential voltage", with the drive voltage V1 set as a median. Each of the print images G21 to G27 is a reed-shaped solid pattern extending over a prescribed width in the main scanning direction (X-axis direction). The print image G1 and the print images G2 (G21 to G27) are printed to lie alternately and adjacently to each other.

In other words, in the printer 100, the plurality of print images G2 to be compared with the print image G1 are printed using the head 1312 driven at the drive voltage V2 set with respect to the drive voltage V1 by using the plurality of differential voltages that are integral multiples of the prescribed differential voltage. Furthermore, the print image G1 is printed between the plurality of print images G2.

The additional information display G3 is a display image indicating the values of the drive voltages (drive voltage V1 and drive voltage V2) corresponding to the print image G1 and the print images G21 to G27, the value of ΔV, and textual information such as ideographic characters A to G corresponding to the "selection information".

The ideographic characters A to G are characters corresponding to the seven print images G21 to G27 and are printed along with the corresponding drive voltage V2 on a −X side of the print images G21 to G27 in association with the print images G21 to G27.

For example, in a case where the print image G2 is selected that is included in the print images G21 to G27 and that has a level recognized to have the smallest difference in density from the print image G1, the corresponding character is selected from the ideographic characters A to G and input from the touch panel 60 to allow the printer control unit 30 to recognize the value of the drive voltage V2 to be corrected.

A printing method (recording method) in the present example will now be described with reference to FIG. 13.

Figure 13:
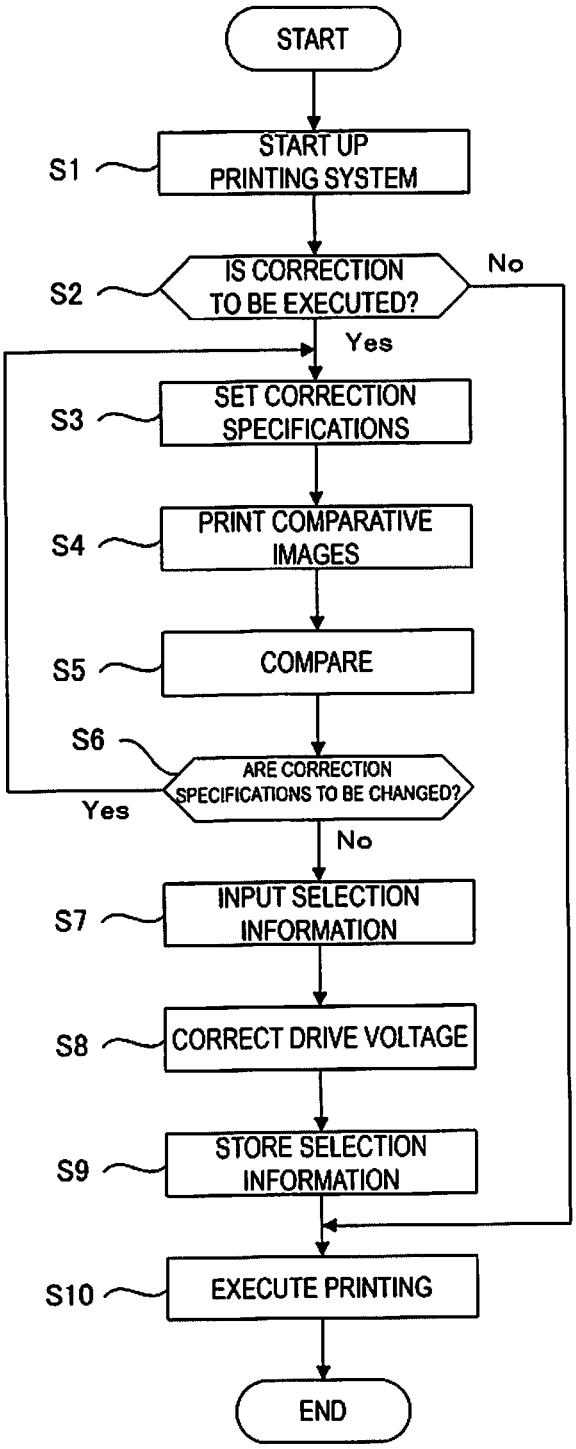
FIG. 13 is a flowchart illustrating a recording method in Exemplary Embodiment 1.

FIG. 13 is a flowchart illustrating a printing method in the present example.

First, the printing system 1 is started up (step S1). When the printing system 1 is started up, a home screen is displayed on the touch panel 60.

The home screen displays a screen (not illustrated) allowing selection of whether to accept printing execution from the image processing apparatus 110 and whether to execute correction of a variation in the discharge characteristics of the head 131. The user inputs, to the touch panel 60, selection of whether or not to execute the correction (step S2).

Then, in a case where the correction is not executed (in a case where the printing execution from the image processing apparatus 110 is accepted, that is, in a case of No in step S2), the printing execution from the image processing apparatus 110 is accepted and printing is executed (step S10).

In a case where the correction is executed (in a case of Yes in step S2), the touch panel 60 displays a screen on which correction specifications are set (not illustrated). The setting screen for correction specifications allows setting of ΔV, the number of levels of the drive voltage V2, and the like. The setting screen for correction specifications displays preset default values for ΔV and the number of levels of the drive voltage V2. The user inputs desired values for the displayed default values as needed to allow the settings to be changed. For example, the user inputs 0.1V for ΔV and 7 for the number of levels of the drive voltage V2 to set the correction specifications (step S3).

Then, the printer 100 prints the print image G, based on the set correction specifications.

For example, for the drive voltage V1=21.0 V, in a case where ΔV=0.1 V and the number of levels of the drive voltage V2=7 are set, the print image G illustrated in FIG. 12 (an image for comparison between the print image G1 and the print images G2) is printed (step S4).

Then, the user references the print image G to compare the print image G1 with the print images G2 (step S5). The user determines whether or not the print image G2 at the level recognized to have the smallest difference in density from the print image G1 falls within an allowable range (whether or not to change the correction specifications and add a further correction value) (step S6). Here, in a case where the difference in density falls outside the allowable range and addition of a further correction value is determined to be needed (in a case of Yes in step S6), an input of a correction specification change instruction is accepted on a screen (not illustrated) displayed on the touch panel 60 after completion of printing of the print image G. The process then returns to the step of changing the correction specifications (step S3).

In a case where the print image G2 at the level recognized to have the smallest difference in density from the print image G1 is determined to fall within the allowable range (in a case of No in step S6), an input of the ideographic character (one of the characters A to G, in other words, the selection information) corresponding to the print image G2 to be selected is accepted on a screen displayed on the touch panel 60 after completion of printing of the print image G (step S7).

Then, the printer control unit 30 sets the drive voltage V2 for execution of printing to the corresponding drive voltage V2 (in other words, corrects the drive voltage V2 with respect to the drive voltage V1 (step S8)) based on the accepted selection information (textual information corresponding to one of the ideographic characters A to G).

The printer control unit 30 then stores the accepted selection information (textual information corresponding to one of the ideographic characters A to G) in the memory 33 (step S9), and shifts to a mode in which the printing execution from the image processing apparatus 110 is accepted.

The printer control unit 30 accepts the printing execution from the image processing apparatus 110 and executes printing (step S10).

Specifically, the printing method (recording method) of the present embodiment (Example 1) is a printing method in the printer 100 including the head 1311 including the plurality of nozzles 74 discharging ink droplets and the head 1312 including the plurality of nozzles 74 discharging ink droplets in a color identical to the color of the ink droplets discharged from the nozzles 74 of the head 1311, and the drive signal generation circuit 37 driving the head 1311 by the drive voltage V1 and driving the head 1312 by the drive voltage V2, the printing method including a step of printing the print image G1 by using the head 1311 and printing the plurality of print images G2 by using the head 1312 while changing the drive voltage V2, a step of accepting the input of the selection information selected based on the comparison between the print image G1 and the plurality of print images G2, and a control step of controlling the drive voltage V2, based on the selection information input from the touch panel 60.

Note that, in the present example, the drive voltage V2 is corrected with respect to the drive voltage V1 is described but that the drive voltage V1 may be corrected with respect to the drive voltage V2. That is, an input of selection information selected based on comparison between a print image G2 formed by the drive voltage V2 and print images G1 formed by the drive voltage V1 with a plurality of levels may be accepted, and the drive voltage V1 may be corrected based on the input selection information.

Alternatively, both the drive voltage V1 and the drive voltage V2 may be corrected to bring the difference in density between the print image G1 and the print images G2 to within the allowable range. That is, an input of selection information selected based on comparison between print images G1 formed by the drive voltage V1 with a plurality of levels and print images G2 formed by the drive voltage V2 with a plurality of levels may be accepted, and the drive voltage V1 and the drive voltage V2 may be corrected based on the input selection information.

In other words, based on the selection information selected based on the print image G1 and the print image G2, the printer control unit 30 executes one of the control for fixing one of the drive voltage V1 and the drive voltage V2 while correcting the other and the control for correcting both the drive voltage V1 and the drive voltage V2 to controllably correct the drive voltage V1 and the drive voltage V2.

Example 2

In the present example, the drive control system driving the printing head 13 is configured to drive, by the drive signal COM1, all the heads 1311 included in each of the six nozzle groups 130 and to drive, by the drive signal COM2, all the heads 1312 included in each of the six nozzle groups 130. That is, the drive signal generation circuit 37 supplies the head control unit 14 with the two drive signals (drive signal COM1 and drive signal COM2) for the 12 heads 131.

Figure 14:
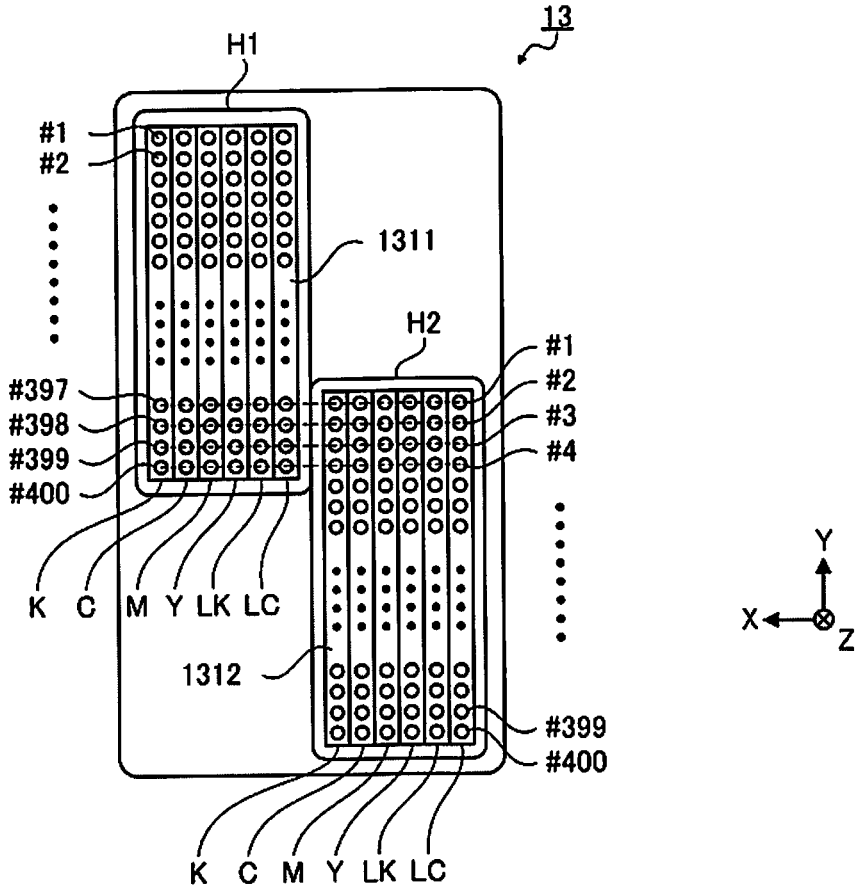
FIG. 14 is a schematic diagram illustrating an example of a configuration of a printing head in Example 2.

Such a configuration can be easily comprehended by being assumed to correspond to, for example, a configuration in which the printing head 13 includes two headsets (headsets H1 and H2) as illustrated in FIG. 14. That is, the printing head 13 illustrated in FIG. 14 is an example of the printing head of the present example.

The headset H1 includes heads 1311 for six colors (black K, cyan C, magenta M, yellow Y, gray LK, and light cyan LC). Each of the heads 1311 is driven by the common drive signal COM1.

The headset H2 includes heads 1312 for six colors (black K, cyan C, magenta M, yellow Y, gray LK, and light cyan LC). Each of the heads 1312 is driven by the common drive signal COM2.

As illustrated by dashed lines in FIG. 14, the headset H1 and the headset H2 are provided to overlap each other in the X-axis direction such that four nozzles 74 in a −Y-direction end region of all the heads 1311 of the headset H1 share the same positions on the Y axis with four nozzles 74 in a +Y-direction end region of all the heads 1312 of the headset H2.

In the present example, the print image G1 printed by driving the headset H1 by the drive voltage V1 is compared with the print images G2 printed by driving the headset H2 by the drive voltage V2 with the plurality of levels. In a case where any difference in density between the headset H1 and the headset H2 is observed, the drive voltage V2 is corrected with respect to the drive voltage V1 in accordance with a result of the comparison.

Figure 15:
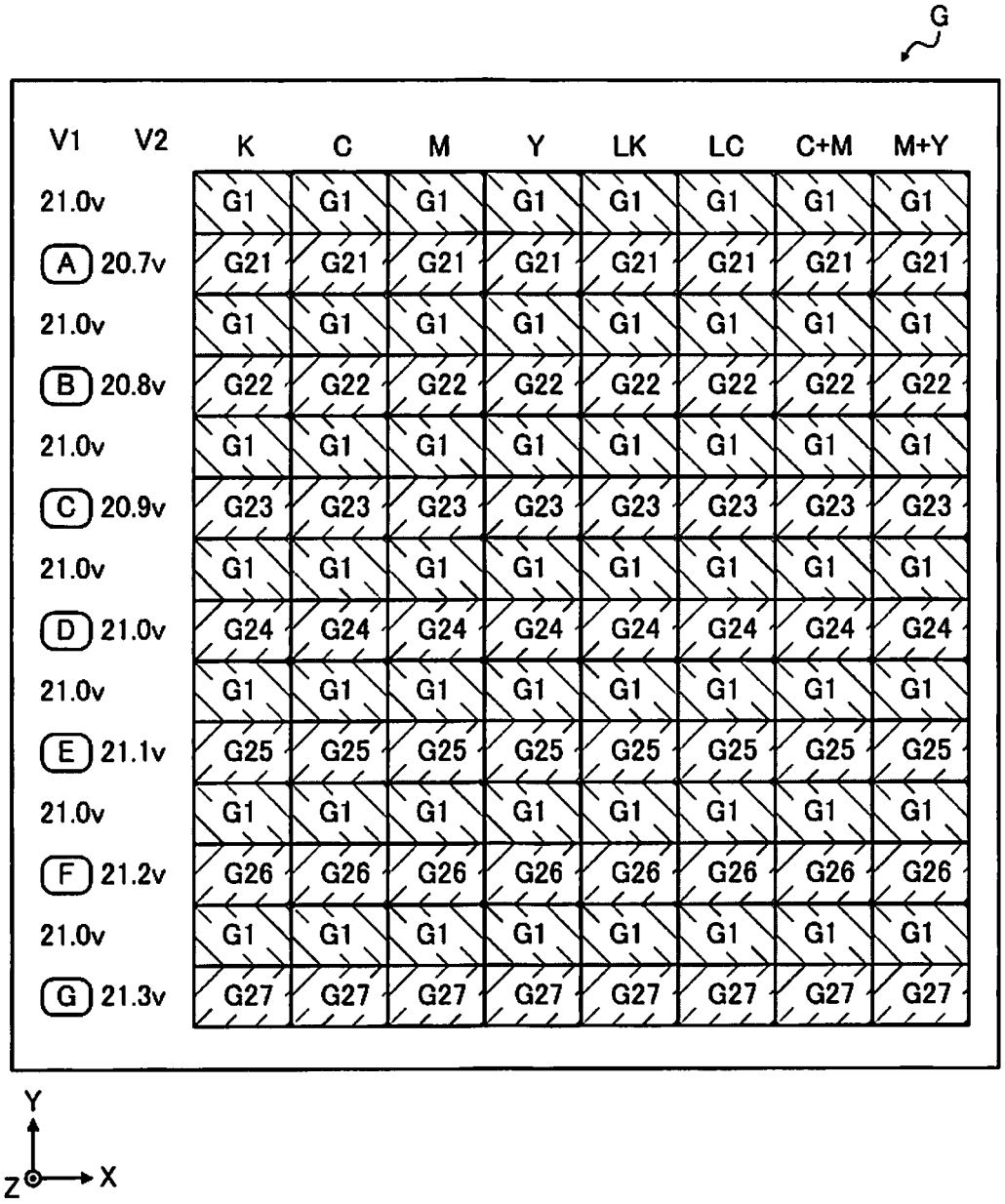
FIG. 15 is a conceptual drawing illustrating an example of a recording image for comparison between a first recording image and second recording images in Example 2.

FIG. 15 is a conceptual drawing illustrating an example of the print image G for comparison between the print image G1 and the print images G2.

The printing head 13 of the present example fails to allow the drive voltage to be independently controlled for each headset (headset H1 or H2) and for each color. Thus, the print images G2 (G21 to G27) formed by the drive voltage V2 with the plurality of levels include, for each single level, a set of images formed using the six individual inks and an image formed using a combination of several inks.

In the example illustrated in FIG. 15, the drive voltage V2 with seven levels ranging from 20.7 V to 21.3 V is used to print solid patterns in a total of eight colors including six colors of black K, cyan C, magenta M, yellow Y, gray LK, and light cyan LC, and a color C+M including a combination of cyan C and magenta M and a color M+Y including a combination of magenta M and yellow Y.

Furthermore, the printer 100 accepts, through the touch panel 60, "selection information" obtained by prompting the user to compare the print image G1 in the above-described eight colors with the print images G2 (G21 to G27) in the same eight colors formed by the drive voltage V2 with the plurality of levels and to select the selection information based on the result of the comparison (the selection information is one of the ideographic characters A to G indicative of a level at which the smallest difference in density between the print image G1 and the print images G2 (all of the print images G21 to G27) is recognized).

Furthermore, the printer control unit 30 controls the drive voltage V1 and the drive voltage V2 for execution of printing based on the accepted selection information.

Example 3

In each of Example 1 and Example 2, the method and the configuration for the method have been described in which the plurality of print images G2 formed by the drive voltage V2 with the plurality of levels and the print image G1 formed by the drive voltage V1 are printed as one image, and in which the entire image is referenced and the level of the drive voltage V2 recognized to be the most appropriate is selected. In contrast, in the present example, the print image G1 formed by the drive voltage V1 and the print image G2 formed by the drive voltage V2 are printed while changing (correcting) the drive voltage V2 with respect to the drive voltage V1, and the drive voltage V2 is set as a correction value when the difference in density between the print image G1 and the print image G2 is recognized to fall within the allowable range.

Details will be described below.

Figure 16:
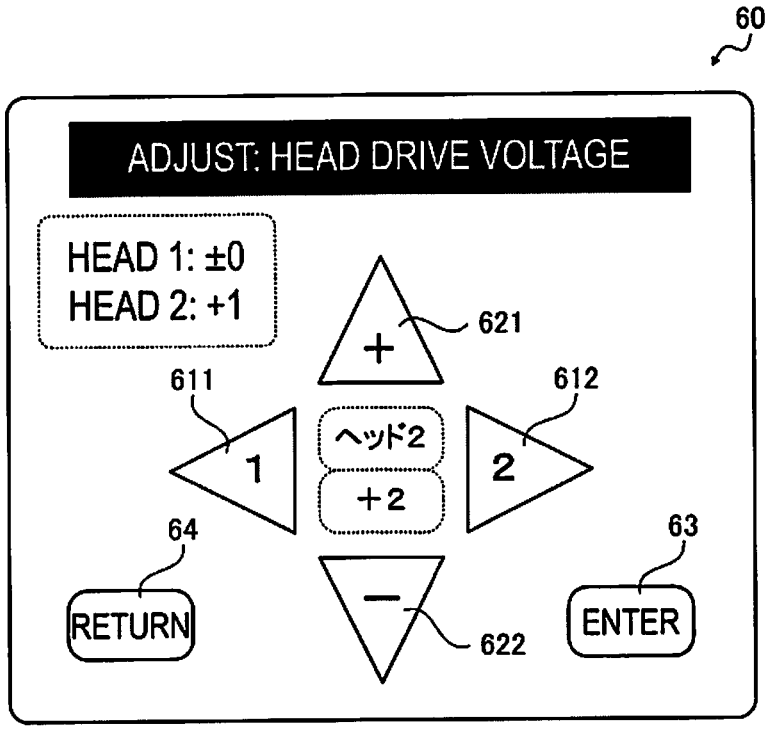
FIG. 16 is a conceptual drawing of a setting screen displayed in an input unit when drive voltages are corrected in Example 3.

FIG. 16 is a conceptual drawing of a setting screen displayed on the touch panel 60 when the drive voltages V1 and V2 are corrected in the present example.

The setting screen is, for example, a menu (not illustrated) in a home screen displayed on the touch panel 60 when the printing system 1 is started up. The setting screen is displayed when a correction mode for the drive voltages is selected.

An upper region of the setting screen includes a display (Adjust: head drive voltage) indicating that the screen is in the correction mode for the drive voltages. Furthermore, a region on a lower left side of the above-described display includes a display indicating a current state of the drive voltage V1 (head 1: ±0) and a current state of the drive voltage V2 (head 2: +1). The display "head 1: ±0" means that the drive voltage V1 is set to a default value. The display head 2: +1 means that the drive voltage V2 is set to a value that is +1 higher than the default value in correction degree (the above-described prescribed differential voltage ΔV).

A central region of the setting screen displays four setting buttons (611, 612, 621, and 622) for setting correction values for the drive voltages V1 and V2, and set and input contents. The setting buttons 611 and 612 are selection buttons for the drive voltage V to be corrected (drive voltage V1 or V2). Pressing the setting button 611 selects the drive voltage V1, and pressing the setting button 612 selects the drive voltage V2.

The setting buttons 621 and 622 are buttons for changing the correction degree. Each press of the setting button 621 sequentially increments the correction degree by one. Each press of the setting button 622 sequentially decrements the correction degree by one. Note that a prescribed differential voltage ΔV corresponding to one correction degree is set to, for example, an initial value of 0.1 V but that the initial value can be changed using another screen (not illustrated) displayed on the touch panel 60.

The set (sequentially input) contents are displayed in the center of the four setting buttons. The example illustrated in FIG. 16 indicates that the drive voltage V2 (head 2) has been selected to be corrected and that the correction degree has been set to be changed to +2 compared to the current setting (head 2: +1).

An enter button 63 is displayed in a lower right region of the setting screen. In a case where the contents displayed in the center are accepted as set values (change values), the enter button 63 is pressed to execute the correction. In other words, the printer control unit 30 recognizes the set (changed) and input contents to correct the drive voltage V1 and the drive voltage V2 for execution of printing.

A return button 64 is displayed in a lower left region of the setting screen. Pressing the return button 64 ends the correction mode for the drive voltages and returns to, for example, the home screen.

Figure 17:
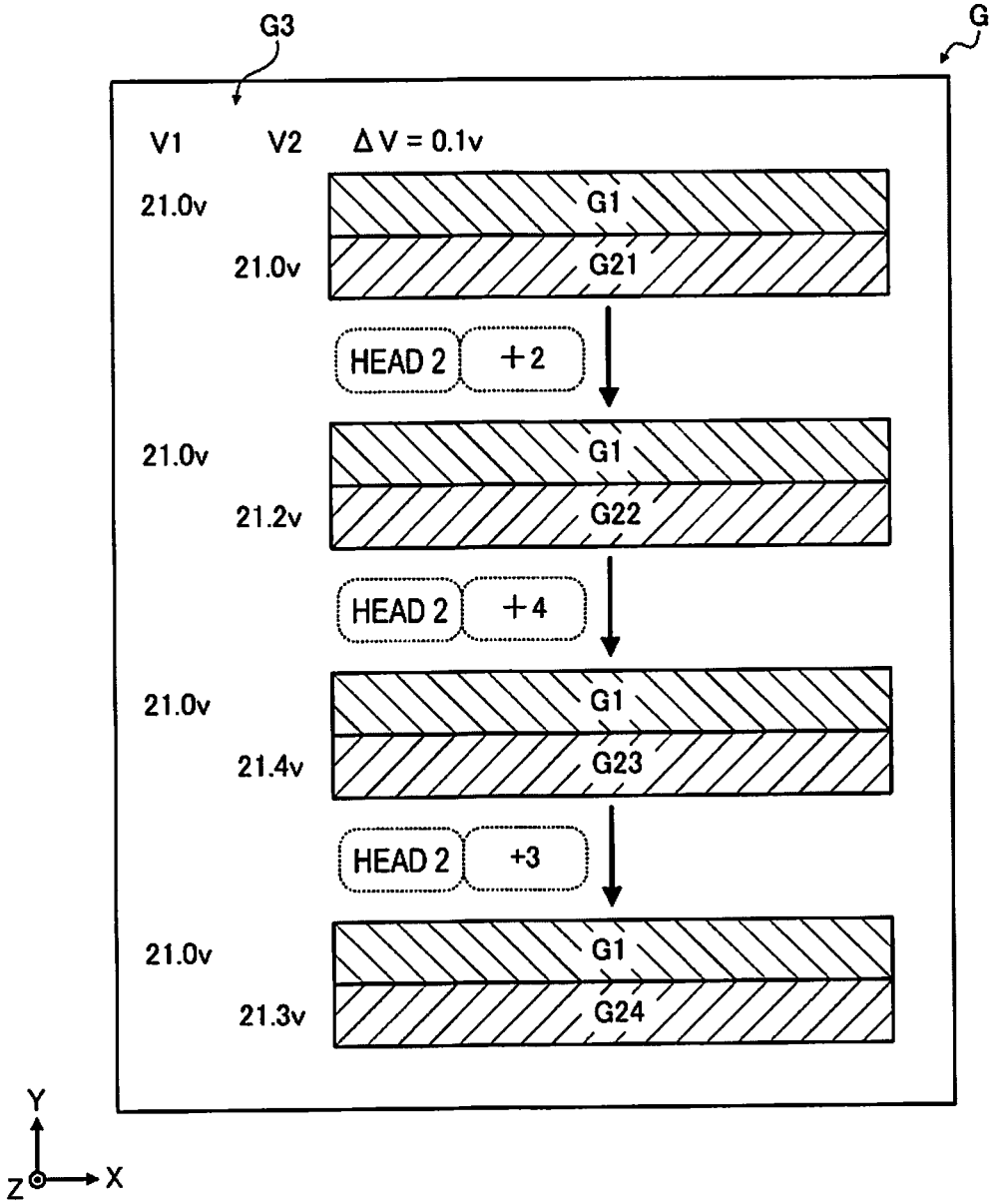
FIG. 17 is a conceptual drawing illustrating examples of a first recording image and second recording images in Example 3.

FIG. 17 is a conceptual drawing illustrating examples of the print images G1 and G2 in the present example.

In the printing head (see FIG. 3) and the drive control system (see FIG. 8) configured as described in Example 1, the drive voltages for the 12 heads 131 (the two heads 131 (head 1311 and head 1312) included in each of the six nozzle groups 130) are independently controlled. Thus, the print images G for correction is provided for each of the heads 131 as needed. Accordingly, in the menu in the home screen, when the correction mode for the drive voltage is selected, the head 131 to be controlled is also specified.

First, as illustrated in an upper region of FIG. 17, the printer 100 (printer control unit 30) prints the print images G1 and G21.

The printer 100 then moves the printing medium 5 in the sub scanning direction (+Y direction) and prompts the user to compare the print image G1 with the print image G21. The printer 100 accepts an instruction based on the result of the comparison (instruction given using the four setting buttons (611, 612, 621, and 622) and the enter button 63).

For example, in a case where the print image G21 is recognized to be lower in density than the print image G1, the user sets the correction degree for the head 2 (drive voltage V2) to, for example, +2 and presses the enter button 63.

The printer 100 (printer control unit 30) then sets the drive voltage V2 to 21.2 V (21.0 V+0.1 V×2) and prints the print images G1 and G22.

The printer 100 then moves the printing medium 5 in the sub scanning direction (+Y direction) and prompts the user to compare the print image G1 with the print image G22. The printer 100 again accepts an instruction based on the result of the comparison (instruction given using the four setting buttons (611, 612, 621, and 622) and the enter button 63).

For example, in a case where the print image G22 is recognized to be still lower in density than the print image G1, the user sets the correction degree for the head 2 (drive voltage V2) to, for example, +4 and presses the enter button 63.

The printer 100 (printer control unit 30) then sets the drive voltage V2 to 21.4 V (21.0 V+0.1 V×4) and prints the print images G1 and G23.

The printer 100 then moves the printing medium 5 in the sub scanning direction (+Y direction) and prompts the user to compare the print image G1 with the print image G23. The printer 100 again accepts an instruction based on the result of the comparison (instruction given using the four setting buttons (611, 612, 621, and 622) and the enter button 63).

For example, in a case where the print image G23 is recognized to be excessively higher in density than the print image G1, the user sets the correction degree for the head 2 (drive voltage V2) to, for example, +3 and presses the enter button 63.

The printer 100 (printer control unit 30) then sets the drive voltage V2 to 21.3 V (21.0 V+0.1 V×3) and prints the print images G1 and G24.

The printer 100 then moves the printing medium 5 in the sub scanning direction (+Y direction) and prompts the user to compare the print image G1 with the print image G24. The printer 100 again accepts an instruction based on the result of the comparison (instruction given using the four setting buttons (611, 612, 621, and 622) and the enter button 63).

For example, in a case where the difference in density between the print image G24 and the print image G1 is recognized to fall within the allowable range, the user presses the return button 64 to end the correction mode for the drive voltages.

In the present example, as described above, the selection information corresponds to the instruction given as the result of the comparison between the print image G1 and each of the plurality of print images G2 using the four setting buttons (611, 612, 621, and 622) and the enter button 63.

As described above, according to the recording device and the recording method according to the present embodiment, the effects below can be achieved.

The printer 100 includes the drive signal generation circuit 37 driving the head 1311 by the drive voltage V1 and driving the head 1312 by the drive voltage V2. The printer 100 can thus print the print image (print image G1) printable using the head 1311 driven at the drive voltage V1 and the print image (print image G2) printable using the head 1312 driven at the drive voltage V2.

Furthermore, the head 1311 and the head 1312 can be driven at the different voltages, thus enabling a reduction in a difference in discharge characteristics between the head 1311 and the head 1312, which can be corrected by correcting the drive voltages.

The printer 100 also includes the touch panel 60 accepting the input of the selection information selected based on the comparison between the print image G1 printed using the head 1311 driven at the drive voltage V1 and the plurality of print images G2 printed using the head 1312 while changing the drive voltage V2 for each of the plurality of print images G2. That is, sensory comparison can be implemented between the print image (print image G1) printed using the head 1311 driven at the drive voltage V1 and the plurality of print images (print images G2) printed using the head 1312 driven at the drive voltage V2 differing from the drive voltage V1 and having the plurality of levels. The printer 100 can accept the input of the selection information selected based on the comparison.

The printer 100 also includes the printer control unit 30 controlling the drive voltage V1 and the drive voltage V2, based on the selection information input from the touch panel 60. That is, the printer 100 can control the drive voltage V1 driving the head 1311 and the drive voltage V2 driving the head 1312, based on the selection information selected based on the comparison between the print image (print image G1) printed using the head 1311 driven at the drive voltage V1 and the plurality of print images (print images G2) printed using the head 1312 driven at the drive voltage V2 differing from the drive voltage V1 and having the plurality of levels.

In other words, the printer 100 of the present embodiment allows the difference in discharge characteristics between the head 1311 and the head 1312 to be sensuously corrected while comparing the print images with each other. That is, a need to preliminarily measure the discharge characteristics of all the heads 131 is eliminated in providing the printer 100 with the difference in discharge characteristics between the head 1311 and the head 1312 corrected.

Furthermore, when actually using the printer, the user can perform correction while comparing the print images with each other. Thus, even in a case where the difference in discharge characteristics between the head 1311 and the head 1312 varies over time, appropriate correction corresponding to the current difference in discharge characteristics can be performed at any time.

The printer 100 also includes the memory 33 used as a "storage unit" storing the selection information input from the touch panel 60 (selection information selected based on the comparison between the print image G1 printed using the head 1311 driven at the drive voltage V1 and the plurality of print images G2 printed using the head 1312 while changing the drive voltage V2 for each of the plurality of print images G2). Thus, the drive voltage V1 driving the head 1311 and the drive voltage V2 driving the head 1312 can be controlled based on the selection information that is stored in and read from the memory 33. This eliminates a need to print and compare the print images for correction (print image G1 and print images G2) for each printing operation.

Furthermore, the plurality of print images G2 to be compared with the print image G1 printed using the head 1311 driven at the drive voltage V1 are printed using the head 1312 driven at the drive voltage V2 set with respect to the drive voltage V1 using the plurality of differential voltages that are integral multiples of the prescribed differential voltage.

That is, the plurality of print images G2 to be compared with the print image G1 are printed using the head 1312 driven at the drive voltage V2 having the plurality of levels and varying from the drive voltage V1 at a step size of the prescribed differential voltage. Thus, for example, in a case where the print image G1 and the print images G2 are printed such that the print images G2 are as similar to the print image G1 as possible, selecting the print image G2 most similar to the print image G1 allows the corresponding drive voltage V2 to be set as a corrected voltage used to drive the head 1312. That is, correction can be easily achieved without inputting specific voltage values for correction.

Furthermore, the print image G1 to be used as a reference is printed between the plurality of print images G2 to be compared with the print image G1 as in Example 1 and Example 2, allowing sensuous comparisons to be more easily performed.

Furthermore, the present embodiment can change the plurality of levels of the drive voltage V2 (the range of the drive voltage V2 with the plurality of levels varying from the drive voltage V1 in a step-by-step manner) set with respect to the drive voltage V1 using the plurality of differential voltages that are integral multiples of the differential voltage ΔV. That is, changing the prescribed differential voltage ΔV can change the level of correction accuracy based on the comparison between the print image G1 and the plurality of print images G2. For example, more accurate correction can be achieved by gradually reducing the value of the prescribed differential voltage ΔV, while selecting the correction value for the drive voltage V2.

Furthermore, the printing method of the present embodiment includes a step of printing the print image G1 using the head 1311 driven at the drive voltage V1 and printing the plurality of print images G2 using the head 1312 driven at the drive voltage V2 while changing the drive voltage V2 for each of the plurality of print images G2. This allows the print image (print image G1) printed using the head 1311 driven at the drive voltage V1 to be sensuously compared with the plurality of print images (print images G2) printed using the head 1312 driven at the drive voltage V2 differing from the drive voltage V1 and having the plurality of levels.

The printing method of the present embodiment also includes a step of accepting the input of the selection information selected based on the comparison between the print image G1 printed using the head 1311 driven at the drive voltage V1 and the plurality of print images G2 printed using the head 1312 while changing the drive voltage V2 for each of the plurality of print images G2. That is, the printing method of the present embodiment allows the print image (print image G1) printed using the head 1311 driven at the drive voltage V1 to be sensuously compared with the plurality of print images (print images G2) printed using the head 1312 driven at the drive voltage V2 differing from the drive voltage V1 and having the plurality of levels. The printing method of the present embodiment further allows acceptance of the input of the selection information selected based on the comparison.

The printing method of the present embodiment also includes a control step of controlling the drive voltage V1 and the drive voltage V2, based on the selection information input from the touch panel 60. That is, the printing method of the present embodiment allows control of the drive voltage V1 driving the head 1311 and the drive voltage V2 driving the head 1312 based on the selection information selected based on the comparison between the print image (print image G1) printed using the head 1311 driven at the drive voltage V1 and the plurality of print images (print images G2) printed using the head 1312 driven at the drive voltage V2 differing from the drive voltage V1 and having the plurality of levels.

In other words, according to the printing method of the present embodiment, the difference in discharge characteristics between the head 1311 and the head 1312 can be sensuously corrected, with the print images compared with each other. That is, the need to preliminarily measure and determine the discharge characteristics of all the heads 131 is eliminated in achieving printing with the difference in discharge characteristics between the head 1311 and the head 1312 corrected.

Furthermore, when actually using the printer, the user can perform correction while comparing the print images with each other. Thus, even in a case where the difference in discharge characteristics between the head 1311 and the head 1312 varies over time, appropriate correction corresponding to the current difference in discharge characteristics can be performed each time the variation occurs.

Exemplary Embodiment 2

Now, a recording device and a recording method according to Exemplary Embodiment 2 will be described. Note that, the same constituents as those in the exemplary embodiment described above are given the same reference signs, and redundant description of these constituents will be omitted.

Exemplary Embodiment 1 has described a case where the printer 100 serving as the "recording device" in a printing system 1 is a serial printer. However, the "recording device" may be a line printer.

Figure 18:
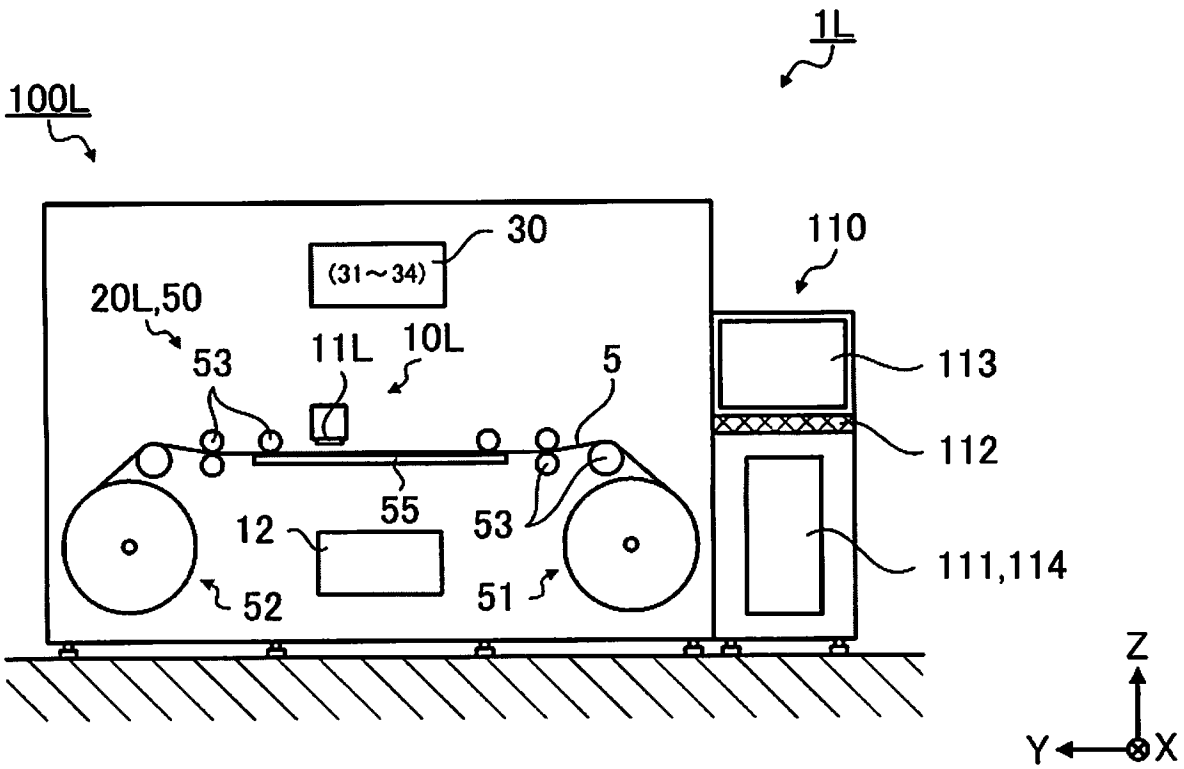
FIG. 18 is a front view illustrating a configuration of a printing system according to Exemplary Embodiment 2.
Figure 19:
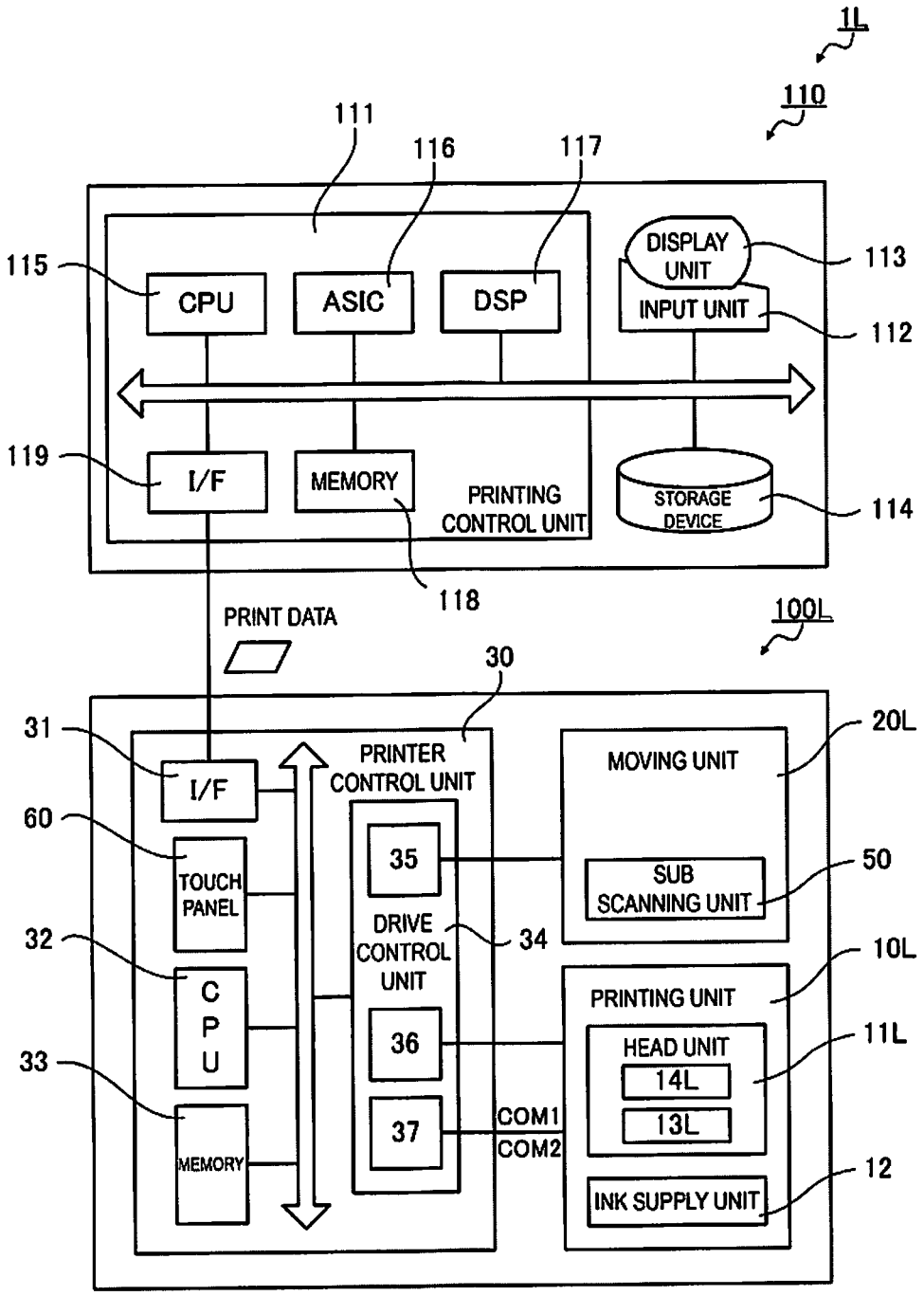
FIG. 19 is a block diagram illustrating a configuration of the printing system according to Exemplary Embodiment 2.

FIG. 18 is a front view illustrating a configuration of a printing system 1L according to Exemplary Embodiment 2, and FIG. 19 is a block diagram of the same.

The printing system 1L includes a printer 100L instead of the printer 100 according to Exemplary Embodiment 1. The printer 100L is an ink-jet line printer that prints a desired image (recording image) on the long-length printing medium 5 supplied in a roll shape, based on print data received from the image processing device 110.

Basic Configuration of Printer 100L

The printer 100L includes a printing unit 10L, a moving unit 20L, a printer control unit 30L, and the like. The printer 100L that has received the printing data from the image processing device 110 controls the printing unit 10L and the moving unit 20L by the printer control unit 30 to print (image-form) an image on the printing medium 5.

The printing unit 10L includes a head unit 11L, the ink supply unit 12, and the like.

The moving unit 20L includes the sub scanning unit 50, and the like. The sub scanning unit 50 includes the supply unit 51, the accommodation unit 52, the transport roller 53, the platen 55, and the like.

The head unit 11L includes a printing head 13L including a plurality of (n) the heads 131 with a plurality of (for example, 400) nozzles 74 arranged in a row, and a head control unit 14L.

Figure 20:
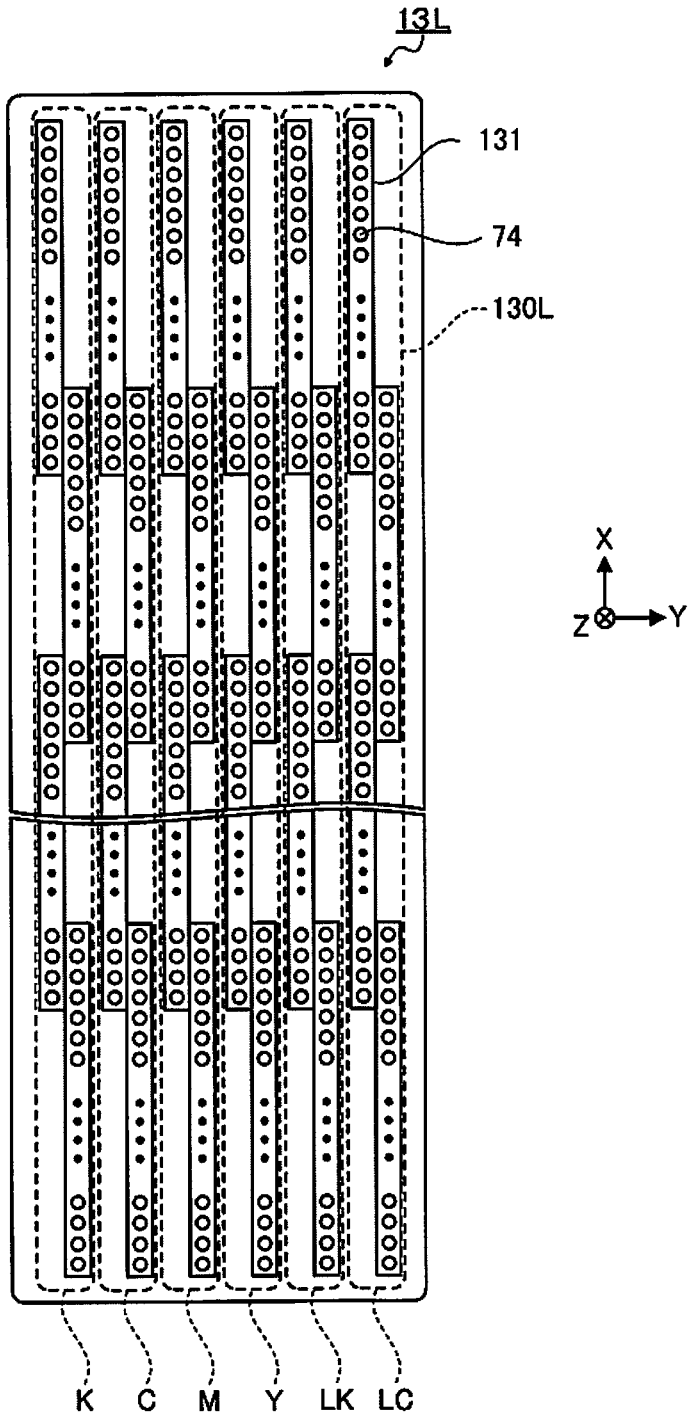
FIG. 20 is a schematic diagram illustrating an example of arrangement of nozzles included in a recording device according to Exemplary Embodiment 2.

FIG. 20 is a schematic diagram illustrating an example of arrangement of the nozzles 74 when viewed from a lower surface of a printing head 13L.

As illustrated in FIG. 20, the printing head 13L includes six nozzle groups 130L from which inks in six colors (black K, cyan C, magenta M, yellow Y, gray LK, and light cyan LC) are discharged. The printing head 13L is what is called a line head. Each of the six nozzle groups includes n heads 131 with nozzles 74 arranged in the X-axis direction and discharging the same ink. The nozzle groups 130L are provided to extend over a length larger than a maximum width of the printing medium 5 in a width direction (X-axis direction) of the printing medium 5 intersecting with a transport direction (Y-axis direction) of the printing medium 5. Furthermore, the heads 131 are provided to overlap one another in the Y-axis direction, with four nozzles 74 at an end portion of one head 131 sharing the same positions with four nozzles 74 at a corresponding end portion of the adjacent head 131 in the X-axis direction.

The head control unit 14L (see FIG. 19) is controlled by the printer control unit 30 based on the print data, to drive the printing head 13L. Description of a configuration of the head control unit 14L is omitted.

Print data is generated by, for example, executing rasterization processing in which pixel data generated based on image data and subjected to halftone processing and arranged in a matrix is developed into the six nozzle groups 130L of the printing head 13L (in other words, processing not including the pass allocation described in Exemplary Embodiment 1).

Even printing using the line head configured as described above may involve a difference in the amount of discharged ink droplets among the heads 131, due to a manufacturing variation among the heads 131. As a result, the printing density varies among the heads 131.

Even in such a case, printing based on an idea similar to the idea for the printing method described in Exemplary Embodiment 1 is executed to enable a reduction in a visually recognized difference in printing density.

In other words, the printer 100L used as a recording device according to Exemplary Embodiment 2 includes a first nozzle row (head 131) including the plurality of nozzles 74 discharging ink droplets and a second nozzle row (head 131) including the plurality of nozzles 74 discharging ink droplets in the color identical to the color of the ink droplets discharged from the first nozzle row, the drive signal generation circuit 37 driving the first nozzle row (head 131) by the drive voltage V1 and driving the second nozzle row (head 131) by the drive voltage V2, the touch panel 60 accepting the input of the selection information selected based on the comparison between the print image G1 printed using the first nozzle row (head 131) and the plurality of print images G2 printed using the second nozzle row (head 131) while changing the drive voltage V2, and the printer control unit 30 controlling the drive voltage V1 and the drive voltage V2 based on the selection information input from the touch panel 60.

Here, the first nozzle row (head 131) is one of the n heads 131 included in the nozzle group 130L, and the second nozzle row (head 131) is one of the n heads 131 included in the nozzle group 130L, the one being adjacent to the first nozzle row (head 131) (four nozzles 74 in an end region of the first nozzle row overlaps, on the Y axis, four nozzles 74 in a corresponding end region of the second nozzle row).

Figure 21:
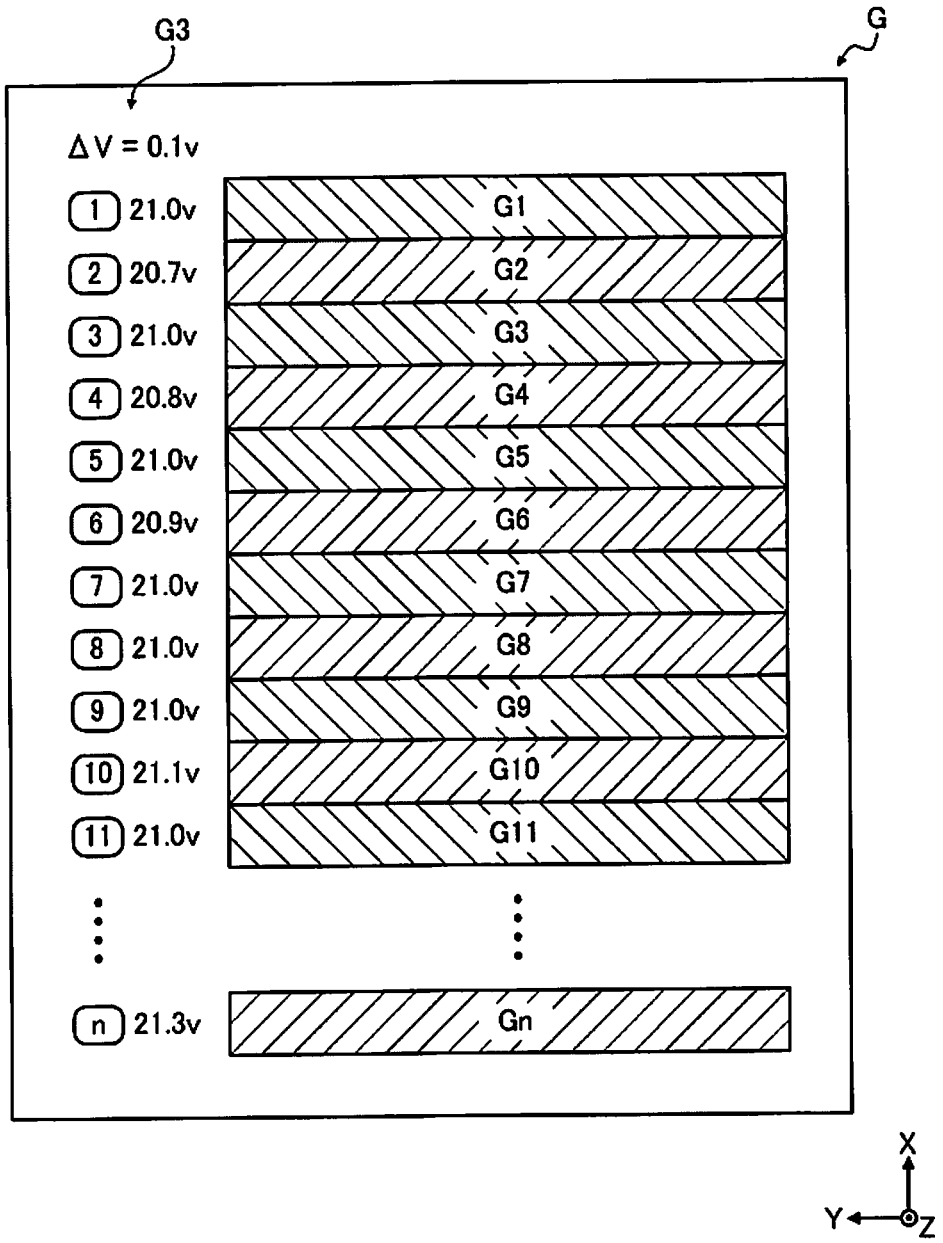
FIG. 21 is a conceptual drawing illustrating an example of a recording image for comparison between a first recording image and second recording images in Exemplary Embodiment 2.

FIG. 21 is a conceptual drawing illustrating examples of the print images G in the present embodiment.

The print image G is an image printed using each of the nozzle groups 130L to allow sensuous recognition of a difference in printing density among the individual heads 131 of the printing head 13L. The print image G includes reed-shaped solid patterns G1 to Gn printed in association with the positions on the X axis of the heads 131 of the nozzle group 130L and extending in the transport direction (Y-axis direction) of the printing medium 5 over the width of each of the heads 131 (to be exact, the width excludes two nozzles 74 in the end region of each head 131 where the heads 131 overlap as illustrated in FIG. 11).

Here, the print image G1, included in the n solid patterns G1 to Gn, refers to a solid pattern Gm printed as a "first recording image" using the first nozzle row (head 131). The print image G2, included in the n solid patterns G1 to Gn, refers to a solid pattern Gm+1 (or a solid pattern Gm−1) printed adjacently to the print image G1 as a "second recording image" using the second nozzle row (head 131).

The print image G1 and the print images G2 are printed adjacently to each other in this manner to enable the degree of a difference in printing density to be visually sensuously recognized.

Figure 22:
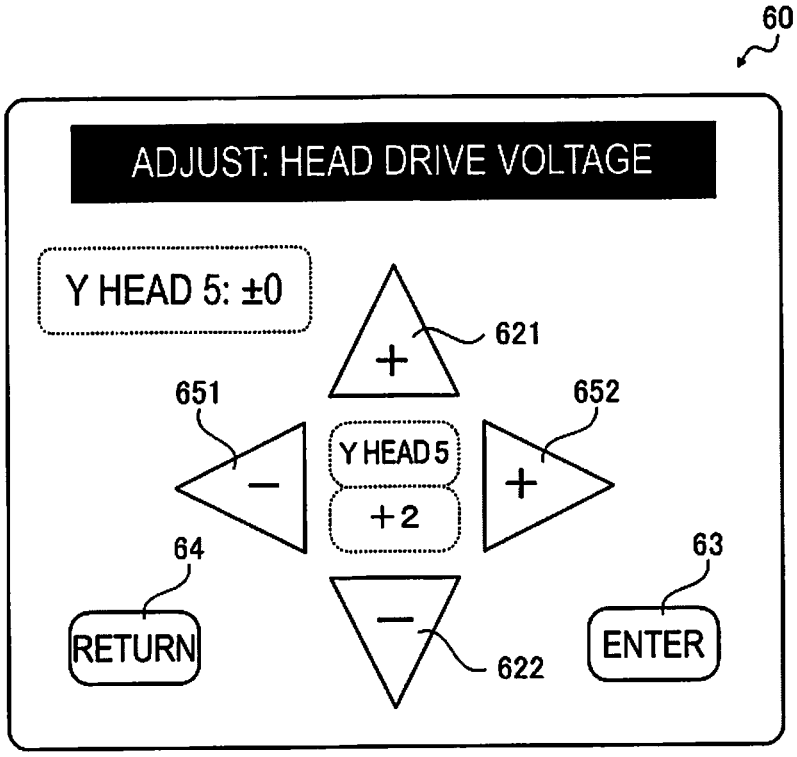
FIG. 22 is a conceptual drawing of a setting screen displayed in an input unit when drive voltages are corrected in Exemplary Embodiment 2.

FIG. 22 is a conceptual drawing of a setting screen displayed on the touch panel 60 when the drive voltages are corrected in the present embodiment.

The setting screen is, for example, the menu (not illustrated) in the home screen displayed on the touch panel 60 when the printing system 1L is started up. The setting screen is displayed when the correction mode for the drive voltages is selected.

The upper region of the setting screen includes the display (Adjust: head drive voltage) indicating that the screen is in the correction mode for the drive voltages. Furthermore, the region on the lower left side of the above-described display includes the display indicating the current state of the drive voltage driving the head 131 selected from the 6×n heads 131. For example, the display "Y head 5: ±0" means that the drive voltage for the fifth head 131 in the nozzle group 130L for yellow Y is set as a default value.

The central region of the setting screen displays four setting buttons (651, 652, 621, and 622) for setting a correction value for the drive voltage, and set and input contents. The setting buttons 651 and 652 are selection buttons for the head 131 to be corrected. Each press of the setting button 651 sequentially changes one of the n heads 131 of the nozzle group 130L for yellow Y to the −X side head 131. Each press of the setting button 652 sequentially changes one of the n heads 131 of the nozzle group 130L for yellow Y to the +X side head 131.

The setting buttons 621 and 622 are buttons for changing the correction degree. Each press of the setting button 621 sequentially increments the correction degree by one. Each press of the setting button 622 sequentially decrements the correction degree by one. Note that a prescribed differential voltage ΔV corresponding to one correction degree is set to, for example, an initial value of 0.1V but that the initial value can be changed using another screen (not illustrated) displayed on the touch panel 60.

The set (sequentially input) contents are displayed in the center of the four setting buttons. The example illustrated in FIG. 22 indicates that, for the drive voltage for the fifth head 131 in the nozzle group 130L for yellow Y, the correction degree is set to change from the default value by +2.

An enter button 63 is displayed in a lower right region of the setting screen. In a case where the contents displayed in the center are accepted as set values (change values), the enter button 63 is pressed to execute the correction. In other words, the printer control unit 30 recognize the set (changed) and input contents to correct the drive voltage for execution of printing.

The return button 64 is displayed in the lower left region of the setting screen. Pressing the return button 64 ends the correction mode for the drive voltages and returns to, for example, the home screen.

The user references the print image G illustrated in the example in FIG. 21 to determine whether or not the difference in density between the adjacent solid patterns (Gm−1, Gm, and Gm+1) falls within an allowable range (whether or not to change the correction specifications to change the correction value). The user specifies the head 131 determined to be corrected, sets a correction value assumed to be necessary, and prints the print image G again. The user can repeat this operation until the user is satisfied with the print image G.

Note that, in the above description, the voltage driving the first nozzle row (head 131) corresponds to a "first voltage" and that the voltage driving the second nozzle row (head 131) corresponds to a "second voltage".

As described above, even in a case where the "recording device" is a line printer, the difference in discharge characteristics among the heads 131 can be sensuously corrected with the print images compared with each other. That is, the need to preliminarily measure and determine the discharge characteristics of all the heads 131 is eliminated in providing the printer 100L with the difference in discharge characteristics among the heads 131 corrected.

Contents derived from the exemplary embodiments are as follows.

The recording device of the disclosure includes a first nozzle row including a plurality of nozzles discharging droplets and a second nozzle row including a plurality of nozzles discharging droplets of a color identical to that of the droplets discharged from the first nozzle row, a driving circuit configured to drive the first nozzle row at a first voltage and drive the second nozzle row at a second voltage, an input unit configured to receive an input of selection information selected, based on comparison between a first recording image recorded by the first nozzle row and a plurality of second recording images recorded by the second nozzle row, with the second voltage being changed accordingly, and a control unit configured to control the first voltage and the second voltage, based on the selection information input from the input unit.

According to this configuration, the recording device includes the drive circuit driving the first nozzle row by the first voltage and driving the second nozzle row by the second voltage. Thus, the recording device can record the recording image (first recording image) recordable using the first nozzle row driven at the first voltage and the recording image (second recording image) recordable using the second nozzle row driven at the second voltage.

Furthermore, the first nozzle row and the second nozzle row can be driven at the different voltages, thus enabling a reduction in the difference in discharge characteristics between the first nozzle row and the second nozzle row, which can be corrected by correcting the drive voltages.

Furthermore, the recording device includes input unit accepting the input of the selection information selected based on the comparison between the first recording image recorded using the first nozzle row driven at the first voltage and the plurality of second recording images recorded using the second nozzle row while changing the second voltage. That is, the recording image (first recording image) recorded using the first nozzle row driven at the first voltage can be sensuously compared with the plurality of recording images (second recording images) recorded using the second nozzle row driven at the second voltage differing from the first voltage and having the plurality of levels. The recording device can accept the input of the selection information selected based on the comparison.

The recording device also includes the control unit controlling the first voltage V1 and the second voltage V2, based on the selection information input from the input unit. That is, the recording device can control the first voltage driving the first nozzle row and the second voltage driving the second nozzle row, based on the selection information selected based on the comparison between the recording image (first recording image) recorded using the first nozzle row driven at the first voltage and the plurality of recording images (second recording images) recorded using the second nozzle row driven at the second voltage differing from the first voltage and having the plurality of levels.

In other words, according to the recording device of the disclosure, the difference in discharge characteristics between the first nozzle row and the second nozzle row can be sensuously corrected, with the recording images compared with each other. That is, the need to preliminarily measure and determine the discharge characteristics of all the nozzle rows is eliminated in providing the recording device with the difference in discharge characteristics between the first nozzle row and the second nozzle row corrected.

Furthermore, when actually using the recording device, the user can perform correction while comparing the recording images with each other. Thus, even in a case where the difference in discharge characteristics between the first nozzle row and the second nozzle row varies over time, appropriate correction corresponding to the current difference in discharge characteristics can be performed in arbitrary time.

The above-described recording device preferably includes a storage unit configured to store the selection information input from the input unit.

According to this configuration, the recording device includes the storage unit storing the selection information (selection information selected based on the comparison between the first recording image recorded using the first nozzle row driven at the first voltage and the plurality of second recording images recorded using the second nozzle row driven at the second voltage while changing the second voltage. Thus, reading the selection information stored in the storage unit allows control of the first voltage driving the first nozzle row and the second voltage driving the second nozzle row, based on the selection information. This eliminates the need to print and compare the recording images for correction (first recording image and second recording image) for each printing operation.

In the above-described recording device, the plurality of second recording images to be compared with the first recording image are preferably recorded by the second nozzle row driven at the second voltage set with respect to the first voltage by a plurality of differential voltages that are integral multiples of a prescribed differential voltage.

According to this configuration, the plurality of second recording images to be compared with the first recording image recorded using the first nozzle row driven at the first voltage are recorded using the second nozzle row driven at the second voltage set with respect to the first voltage using the plurality of differential voltages that are integral multiples of the prescribed differential voltage.

That is, the plurality of second recording images to be compared with the first recording image are recorded using the second nozzle row driven at the second voltage having the plurality of levels and varying from the first voltage at a step size of the prescribed differential voltage. Thus, for example, in a case where the first recording image and the second recording images are recorded such that the second recording images are as similar to the first recording image as possible, selecting the second recording image most similar to the first recording image allows the corresponding second voltage to be set as a corrected voltage used to drive the second nozzle row. That is, correction can be easily achieved without inputting specific voltage values for correction.

In the above-described recording device, the first recording image is preferably recorded between the plurality of second recording images.

According to this configuration, the first recording image to be used as a reference is recorded between a plurality of the second recording images to be compared with the first recording image, allowing sensuous comparisons to be more easily performed.

In the above-described recording device, the input unit is preferably configured to accept a change instruction for changing the prescribed differential voltage.

According to this configuration, the input unit accepts the change instruction to change the prescribed differential voltage. This enables a change in the range of the plurality of levels of the second voltage (the range of the second voltage with the plurality of levels varying from the first voltage in a step-by-step manner) set with respect to the first voltage using the plurality of differential voltages that are integral multiples of a prescribed differential voltage. That is, changing the prescribed differential voltage can change the level of correction accuracy based on the comparison between the first recording image and the plurality of second recording images. For example, more accurate correction can be achieved by gradually reducing the value of the prescribed differential voltage, while selecting the correction value for the second voltage.

The recording method of the disclosure is a recording method in a recording device in a recording device including a first nozzle row including a plurality of nozzles discharging droplets and a second nozzle row including a plurality of nozzles discharging droplets of a color identical to that of the droplets discharged from the first nozzle row, and a driving circuit configured to drive the first nozzle row at a first voltage and drive the second nozzle row at a second voltage, the recording method including recording a first recording image by the first nozzle row and recording a plurality of second recording images by the second nozzle row, with the second voltage being changed accordingly, accepting an input of selection information selected, based on comparison between the first recording image and the plurality of second recording images, and controlling the first voltage and the second voltage, based on the selection information that has been input.

The recording method includes the step of recording the first recording image using the first nozzle row driven at the first voltage and recording the plurality of second recording images using the second nozzle row driven at the second voltage while changing the second voltage. Thus, the recording image (first recording image) recorded using the first nozzle row driven at the first voltage can be sensuously compared with the plurality of recording images (second recording images) recorded using the second nozzle row driven at the second voltage differing from the first voltage and having the plurality of levels.

Furthermore, the recording method includes the step of accepting the input of the selection information selected based on the comparison between the first recording image recorded using the first nozzle row driven at the first voltage and the plurality of second recording images recorded using the second nozzle row while changing the second voltage. That is, the recording image (first recording image) recorded using the first nozzle row driven at the first voltage can be sensuously compared with the plurality of recording images (second recording images) recorded using the second nozzle row driven at the second voltage differing from the first voltage and having the plurality of levels. The input of the selection information selected based on the comparison can be accepted.

The recording method also includes the control step of controlling the first voltage and the second voltage, based on the selection information input from the input unit. That is, the first voltage driving the first nozzle row and the second voltage driving the second nozzle row can be controlled based on the selection information selected based on the comparison between the recording image (first recording image) recorded using the first nozzle row driven at the first voltage and the plurality of recording images (second recording images) recorded using the second nozzle row driven at the second voltage differing from the first voltage and having the plurality of levels.

In other words, according to the recording method of the disclosure, the difference in discharge characteristics between the first nozzle row and the second nozzle row can be sensuously corrected, with the recording images compared with each other. That is, the need to preliminarily measure and determine the discharge characteristics of all the nozzle rows is eliminated in performing recording with the difference in discharge characteristics between the first nozzle row and the second nozzle row corrected.

Furthermore, when actually using the recording device, the user can perform correction while comparing the recording images with each other. Thus, even in a case where the difference in discharge characteristics between the first nozzle row and the second nozzle row varies over time, appropriate correction corresponding to the current difference in discharge characteristics can be performed in arbitrary time.

What is claimed is:

1. A recording device comprising:

a first nozzle row including a plurality of nozzles discharging droplets and a second nozzle row including a plurality of nozzles discharging droplets of a color identical to that of the droplets discharged from the first nozzle row;

a driving circuit configured to drive the first nozzle row at a first voltage and drive the second nozzle row at a second voltage;

an input unit configured to receive an input of selection information selected based on comparison between a first recording image recorded by the first nozzle row and a plurality of second recording images recorded by the second nozzle row, with the second voltage being changed accordingly; and a control unit configured to control the first voltage and the second voltage based on the selection information input from the input unit.

2. The recording device according to claim 1, comprising a storage unit configured to store the selection information input from the input unit.

3. The recording device according to claim 1, wherein the plurality of second recording images to be compared with the first recording image are recorded by the second nozzle row driven at the second voltage set with a plurality of differential voltages, which are integral multiples of a prescribed differential voltage, with respect to the first voltage.

4. The recording device according to claim 3, wherein the first recording image is recorded between the plurality of second recording images.

5. The recording device according to claim 3, wherein the input unit is configured to accept a change instruction for changing the prescribed differential voltage.

6. A recording method for a recording device including a first nozzle row including a plurality of nozzles discharging droplets and a second nozzle row including a plurality of nozzles discharging droplets of a color identical to that of the droplets discharged from the first nozzle row, and a driving circuit configured to drive the first nozzle row at a first voltage and drive the second nozzle row at a second voltage, the recording method comprising:

recording a first recording image by the first nozzle row and recording a plurality of second recording images by the second nozzle row, with the second voltage being changed accordingly;

accepting an input of selection information selected, based on comparison between the first recording image and the plurality of second recording images; and controlling the first voltage and the second voltage, based on the selection information that has been input.

* * * * *